US008757299B2

(12) United States Patent
DiGiovanni et al.

(10) Patent No.: US 8,757,299 B2
(45) Date of Patent: Jun. 24, 2014

(54) CUTTING ELEMENT AND METHOD OF FORMING THEREOF

(75) Inventors: Anthony A. DiGiovanni, Houston, TX (US); Nicholas J. Lyons, Sugar Land, TX (US); Matthew S. Hale, Houston, TX (US); Konstantin E. Morozov, The Woodlands, TX (US); John H. Liversage, Gauteng (ZA); Danny E. Scott, Montgomery, TX (US); Allen Sinor, Conroe, TX (US)

(73) Assignees: Baker Hughes Incorporated, Houston, TX (US); Element Six (Production) (Pty) Ltd., Gauteng (ZA); Element Six Limited, County Clare (IE)

( * ) Notice: Subject to any disclaimer, the term of this patent is extended or adjusted under 35 U.S.C. 154(b) by 737 days.

(21) Appl. No.: 12/832,817

(22) Filed: Jul. 8, 2010

(65) Prior Publication Data

US 2011/0024200 A1 Feb. 3, 2011

Related U.S. Application Data

(60) Provisional application No. 61/223,747, filed on Jul. 8, 2009.

(51) Int. Cl.
*E21B 10/567* (2006.01)
*E21B 10/573* (2006.01)

(52) U.S. Cl.
USPC ..... 175/428; 175/433; 175/434; 175/435

(58) Field of Classification Search
USPC ..... 175/428, 430, 432, 433, 434, 435
See application file for complete search history.

(56) References Cited

U.S. PATENT DOCUMENTS

| | | | |
|---|---|---|---|
| 2,947,609 | A | 8/1960 | Strong |
| 3,596,649 | A | 8/1971 | Olivieri |
| 4,128,136 | A | 12/1978 | Generoux |
| 4,186,628 | A | 2/1980 | Bonnice |
| 4,255,165 | A | 3/1981 | Dennis et al. |
| 4,299,471 | A | 11/1981 | Alex et al. |

(Continued)

FOREIGN PATENT DOCUMENTS

| | | | |
|---|---|---|---|
| EP | 0546725 | A1 | 6/1993 |
| EP | 0582484 | A1 | 2/1994 |

(Continued)

OTHER PUBLICATIONS

Bertagnolli, K.E., and Vale, R., 2000, "Understanding and Controlling Residual Stresses in Thick Polycrystalline Diamond Cutters for Enhanced Durability," Proceedings, Intertech 2000: An International Technical Conference on Diamond,Cubic Boron Nitride and their Applications, Vancouver, BC, Jul. 17-21, 2000.

(Continued)

*Primary Examiner* — David Andrews
*Assistant Examiner* — Robert E Fuller
(74) *Attorney, Agent, or Firm* — TraskBritt

(57) ABSTRACT

A cutting element for use in a drilling bit and/or milling bit having a cutter body made of a substrate having an upper surface, and a superabrasive layer overlying the upper surface of the substrate. The cutting element further including a sleeve extending around a portion of a side surface of the superabrasive layer and a side surface of the substrate, wherein the sleeve exerts a radially compressive force on the superabrasive layer.

6 Claims, 13 Drawing Sheets

(56) References Cited

U.S. PATENT DOCUMENTS 4,351,401 A 9/1982 Fielder
4,385,907 A 5/1983 Tomita et al.
4,471,845 A 9/1984 Jurgens
4,478,298 A 10/1984 Hake et al.
4,592,433 A 6/1986 Dennis
4,604,106 A 8/1986 Hall et al.
4,662,896 A 5/1987 Dennis
4,676,124 A 6/1987 Fischer
4,718,505 A 1/1988 Fuller
4,764,255 A 8/1988 Fischer et al.
4,797,138 A 1/1989 Komanduri
4,828,436 A 5/1989 Briese
4,850,523 A 7/1989 Slutz
4,861,350 A 8/1989 Phaal et al.
4,866,885 A 9/1989 Dodsworth
4,919,220 A 4/1990 Fuller et al.
4,932,484 A 6/1990 Warren et al.
4,987,800 A 1/1991 Gasan et al.
4,991,670 A 2/1991 Fuller et al.
4,993,888 A 2/1991 Briese
4,997,049 A 3/1991 Tank et al.
5,025,873 A 6/1991 Cerkovnik
5,028,177 A 7/1991 Meskin et al.
5,030,276 A 7/1991 Sung et al.
5,049,164 A 9/1991 Horton et al.
5,057,124 A 10/1991 Cerceau
5,116,568 A 5/1992 Sung et al.
5,119,714 A 6/1992 Scott et al.
5,147,001 A 9/1992 Chow et al.
5,154,245 A 10/1992 Waldenstrom et al.
5,159,857 A 11/1992 Jurewicz
5,173,090 A 12/1992 Scott et al.
5,199,832 A 4/1993 Meskin et al.
5,217,081 A 6/1993 Waldenstrom et al.
5,232,320 A 8/1993 Tank et al.
5,238,074 A 8/1993 Tibbitts et al.
5,248,317 A 9/1993 Tank et al.
5,264,283 A 11/1993 Waldenstrom et al.
5,273,125 A 12/1993 Jurewicz
5,282,513 A 2/1994 Jones
5,299,471 A 4/1994 Tank et al.
5,370,717 A 12/1994 Lloyd et al.
5,421,423 A 6/1995 Huffstutler
5,431,239 A 7/1995 Tibbitts et al.
5,433,778 A 7/1995 Sleight
5,435,403 A 7/1995 Tibbitts
5,437,343 A 8/1995 Cooley et al.
5,492,188 A 2/1996 Smith et al.
5,499,688 A 3/1996 Dennis
5,514,360 A 5/1996 Sleight et al.
5,535,838 A 7/1996 Keshavan et al.
5,549,171 A 8/1996 Mensa-Wilmot et al.
5,551,522 A 9/1996 Keith et al.
5,582,261 A 12/1996 Keith et al.
5,651,421 A 7/1997 Newton et al.
5,667,028 A 9/1997 Truax et al.
5,706,906 A 1/1998 Jurewicz et al.
5,720,357 A 2/1998 Fuller et al.
5,722,497 A 3/1998 Gum et al.
5,740,874 A 4/1998 Matthias
5,755,299 A 5/1998 Langford, Jr. et al.
5,776,550 A 7/1998 Disam et al.
5,816,346 A 10/1998 Beaton
5,819,862 A 10/1998 Matthias et al.
5,871,060 A 2/1999 Jensen et al.
5,881,830 A 3/1999 Cooley
5,904,213 A 5/1999 Caraway et al.
5,906,245 A 5/1999 Tibbitts et al.
5,919,720 A 7/1999 Sleight et al.
5,924,501 A 7/1999 Tibbitts
5,947,609 A 9/1999 Lee et al.
5,960,896 A 10/1999 Barr et al.
5,967,249 A 10/1999 Butcher
5,974,609 A 11/1999 Nunez et al.
5,975,811 A 11/1999 Briese
5,979,571 A 11/1999 Scott et al.
5,979,578 A 11/1999 Packer
5,979,579 A 11/1999 Jurewicz
6,000,483 A 12/1999 Jurewicz et al.
6,003,623 A 12/1999 Miess
6,009,962 A 1/2000 Beaton
6,068,071 A 5/2000 Jurewicz
6,077,591 A * 6/2000 Griffin ..... 428/172
6,082,223 A 7/2000 Tibbitts
6,098,729 A 8/2000 Matthias
6,102,140 A 8/2000 Boyce et al.
6,123,161 A 9/2000 Taylor
6,132,676 A 10/2000 Holzer et al.
6,145,607 A 11/2000 Griffin et al.
6,148,938 A 11/2000 Beaton
6,164,394 A 12/2000 Mensa-Wilmot et al.
6,183,716 B1 2/2001 Sleight et al.
6,187,068 B1 2/2001 Frushour et al.
6,187,700 B1 2/2001 Merkel
6,189,634 B1 2/2001 Bertagnolli et al.
6,193,001 B1 2/2001 Eyre et al.
6,202,770 B1 3/2001 Jurewicz et al.
6,202,771 B1 3/2001 Scott et al.
6,216,805 B1 4/2001 Lays et al.
6,218,324 B1 4/2001 Goettler
6,220,375 B1 4/2001 Butcher et al.
6,230,828 B1 5/2001 Beuershausen et al.
6,258,743 B1 7/2001 Fleming et al.
6,283,233 B1 9/2001 Lamine et al.
6,315,066 B1 11/2001 Dennis
6,326,685 B1 12/2001 Jin et al.
6,401,844 B1 6/2002 Doster et al.
6,401,845 B1 6/2002 Fielder
6,403,511 B2 6/2002 Fleming et al.
6,412,580 B1 7/2002 Chaves
6,439,327 B1 8/2002 Griffin et al.
6,446,740 B2 9/2002 Eyre
6,481,511 B2 11/2002 Griffin et al.
6,510,906 B1 1/2003 Richert et al.
6,521,174 B1 2/2003 Butcher et al.
6,612,383 B2 9/2003 Desai et al.
6,672,406 B2 1/2004 Beuershausen
6,739,417 B2 5/2004 Smith et al.
6,742,611 B1 6/2004 Illerhaus et al.
6,823,952 B1 11/2004 Mensa-Wilmot et al.
6,872,356 B2 3/2005 Butcher et al.
6,892,836 B1 * 5/2005 Eyre et al. ..... 175/432
6,935,444 B2 8/2005 Lund et al.
7,070,011 B2 7/2006 Sherwood, Jr. et al.
7,105,235 B2 9/2006 Lo et al.
7,159,487 B2 1/2007 Mensa-Wilmot et al.
7,188,692 B2 3/2007 Lund et al.
7,237,628 B2 7/2007 Desai et al.
7,350,601 B2 4/2008 Belnap et al.
7,363,992 B2 4/2008 Stowe et al.
7,377,341 B2 5/2008 Middlemiss et al.
7,395,882 B2 7/2008 Oldham et al.
7,462,003 B2 12/2008 Middlemiss
7,473,287 B2 1/2009 Belnap et al.
7,487,849 B2 2/2009 Radtke
7,493,973 B2 2/2009 Keshavan et al.
7,594,553 B2 9/2009 Tank et al.
7,624,818 B2 12/2009 McClain et al.
7,757,793 B2 7/2010 Voronin et al.
7,909,121 B2 * 3/2011 Voronin et al. ..... 175/435
8,210,288 B2 7/2012 Chen et al.
8,309,050 B2 11/2012 Keshavan et al.
2001/0031692 A1 10/2001 Fleming et al.
2003/0084894 A1 5/2003 Sung
2003/0218268 A1 11/2003 Morito et al.
2004/0007394 A1 1/2004 Griffin
2005/0077091 A1 4/2005 Butland et al.
2005/0100743 A1 5/2005 Hougham et al.
2005/0101133 A1 5/2005 Tzeng et al.
2005/0263328 A1 12/2005 Middlemiss
2006/0032677 A1 2/2006 Azar et al.
2006/0060390 A1 3/2006 Eyre
2006/0070771 A1 4/2006 McClain et al.
2006/0099895 A1 5/2006 Tank et al.

(56) References Cited

U.S. PATENT DOCUMENTS

| | | | | |
|---|---|---|---|---|
| 2006/0144621 | A1 | 7/2006 | Tank et al. | |
| 2006/0162969 | A1 | 7/2006 | Belnap et al. | |
| 2006/0191723 | A1 | 8/2006 | Keshavan | |
| 2006/0207802 | A1 | 9/2006 | Zhang et al. | |
| 2006/0219439 | A1 | 10/2006 | Shen et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2007/0029114 | A1 | 2/2007 | Middlemiss | |
| 2007/0034416 | A1* | 2/2007 | Cho et al. | 175/434 |
| 2007/0079995 | A1 | 4/2007 | McClain et al. | |
| 2007/0135550 | A1 | 6/2007 | Chakrapani et al. | |
| 2007/0187155 | A1 | 8/2007 | Middlemiss | |
| 2007/0235230 | A1 | 10/2007 | Cuillier et al. | |
| 2007/0261890 | A1 | 11/2007 | Cisneros | |
| 2007/0267227 | A1 | 11/2007 | Mensa-Wilmot | |
| 2007/0278014 | A1 | 12/2007 | Cariveau | |
| 2007/0278017 | A1 | 12/2007 | Shen et al. | |
| 2007/0284152 | A1 | 12/2007 | Eyre et al. | |
| 2008/0010905 | A1 | 1/2008 | Eyre | |
| 2008/0023231 | A1 | 1/2008 | Vail | |
| 2008/0047484 | A1 | 2/2008 | Sung | |
| 2008/0105466 | A1 | 5/2008 | Hoffmaster et al. | |
| 2008/0142267 | A1 | 6/2008 | Griffin et al. | |
| 2008/0164071 | A1 | 7/2008 | Patel et al. | |
| 2008/0179108 | A1 | 7/2008 | McClain et al. | |
| 2008/0179109 | A1 | 7/2008 | Belnap et al. | |
| 2008/0206576 | A1 | 8/2008 | Qian et al. | |
| 2008/0223621 | A1 | 9/2008 | Middlemiss et al. | |
| 2008/0236899 | A1 | 10/2008 | Oxford et al. | |
| 2008/0236900 | A1 | 10/2008 | Cooley et al. | |
| 2008/0264696 | A1 | 10/2008 | Dourfaye et al. | |
| 2008/0302575 | A1 | 12/2008 | Duraurajan et al. | |
| 2008/0308276 | A1 | 12/2008 | Scott | |
| 2009/0030658 | A1 | 1/2009 | Duraurajan et al. | |
| 2009/0032169 | A1 | 2/2009 | Dourfaye et al. | |
| 2009/0032571 | A1 | 2/2009 | Smith | |
| 2009/0120008 | A1 | 5/2009 | Lockwood et al. | |
| 2009/0173014 | A1 | 7/2009 | Voronin et al. | |
| 2009/0173548 | A1 | 7/2009 | Voronin et al. | |
| 2009/0218146 | A1 | 9/2009 | Fang et al. | |
| 2010/0012390 | A1 | 1/2010 | Shamburger | |
| 2010/0084197 | A1 | 4/2010 | Voronin et al. | |
| 2010/0104874 | A1 | 4/2010 | Yong et al. | |
| 2010/0288564 | A1 | 11/2010 | Dovalina, Jr. et al. | |
| 2010/0300767 | A1 | 12/2010 | Cariveau et al. | |
| 2010/0326740 | A1 | 12/2010 | Hall et al. | |
| 2010/0326742 | A1 | 12/2010 | Vempati et al. | |
| 2011/0017520 | A1* | 1/2011 | Webb | 175/428 |
| 2011/0023377 | A1 | 2/2011 | DiGiovanni | |
| 2011/0031031 | A1 | 2/2011 | Vempati et al. | |
| 2011/0073379 | A1 | 3/2011 | DiGiovanni et al. | |
| 2011/0297450 | A1* | 12/2011 | Can et al. | 175/426 |

FOREIGN PATENT DOCUMENTS

| | | | |
|---|---|---|---|
| EP | 0501447 | B1 | 11/2000 |
| EP | 0733776 | B1 | 9/2003 |
| EP | 1052367 | B | 4/2005 |
| JP | 11-165261 | A | 6/1999 |
| KR | 10-0853060 | B1 | 8/2008 |
| WO | 9929465 | A1 | 6/1999 |
| WO | 02/11876 | A2 | 2/2002 |
| WO | 2007089590 | A2 | 8/2007 |
| WO | 2007014806 | A1 | 12/2007 |
| WO | 2010097784 | A1 | 9/2010 |

OTHER PUBLICATIONS

Catafesta, Jadna. "Tunable Linear Thermal Expansion Coefficient of Amorphous Zirconium Tungstate." Journal of The American Cermamic Society. 89.7 (2006): 2341-2344.

Cetinkol, Mehmet et al. "Pressure dependence of negative thermal expansion in Zr2(WO4)(PO4)2." Solid State Communication. 149. (2009): 421-424.

Chen, B et al. "High-pressure optical study of HfW2O8." Journal of Physics:Condensed Matter. 14. (2002): 13911-13916.

Clegg, J. "Faster and Longer Bit Runs With New-Generation PDC Cutter." Journal of Petroleum Technology. 58.12 (2006): 73-75.

Grzechnik, Andrzej et al. "Structural transformations in cubic ZrMo2O8 at high pressures and high temperatures." Solid State Sciences. 4. (2002): 1137-1141.

Ravindran, T.R. et al. "High Pressure Behavior of ZrW2O8: Gruneisen Parameter and Thermal Properties." American Physical Society: Physical Review Letters. 84.17 (2000): 3879-3882.

Ravindran, T.R. et al. "Erratum: High Pressure Behavior of ZrW2O8: Gruneisen Parameter and Thermal Properties." American Physical Society: Physical Review Letters. 85.1 (2000): 225.

David, W.I.F., Evans, J.S.O., and Sleight, A.W., "Zirconium Tungstate: The Incredible Shrinking Material," 1997 ISIS Laboratory Scientific Highlights.

Sleight, Arthur W. "Negative thermal expansion material." Current Opinion in Solid State & Materials Science. 3. (1998): 128-131.

R.L. Mehan et al., "Thermal Degradation of Sintered Diamond Compacts," Materials Research Laboratory, Report No. 88CRD041, Manuscript, 20 pages.

Fran Cverna (Technical Editor), "Thermal Properties of Metals: Chapter 2—Thermal Expansion," ASM International, <http://www.asminternational.org>, ASM Ready Reference: Thermal Properties of Metals, Product Code: 06702G, 2002, 9 pages.

The International Search Report and the Written Opinion for International Application No. PCT/US2010/043416 received from the International Searching Authority (ISA/KR) dated Mar. 2, 2011, 9 pages.

The International Search Report and the Written Opinion for International Application No. PCT/US2010/033517 received from the International Searching Authority (ISA/KR) dated Jan. 10, 2011, 8 pages.

The International Search Report and the Written Opinion for International Application No. PCT/US2010/041413 received from the International Searching Authority (ISA/KR) dated Feb. 21, 2011, 12 pages.

The International Search Report and the Written Opinion for International Application No. PCT/US2010/039794 received from the International Searching Authority (ISA/KR) dated Feb. 8, 2011, 6 pages.

The International Search Report and the Written Opinion for International Application No. PCT/US2010/041411 received from the International Searching Authority (ISA/KR) dated Feb. 21, 2011, 9 pages.

The International Search Report and the Written Opinion for International Application No. PCT/US2010/050252 received from the International Searching Authority (ISA/KR) dated Apr. 27, 2011, 13 pages.

"US Synthetic Basics of PCD Manufacturing Training Course", Orem, Utah; Oct. 2003 (34 pages).

Dan Scott; "The History and Impact of Synthetic Diamond Cutters and Diamond Enhanced Inserts on the Oil and Gas Industry"; Industrial Diamond Review Jan. 2006 (11 pages).

Karasawa, Hirokazu. "Laboratory Testing to Design PDC Bits for Geothermal Well Drilling." National Institute for Resources and Environment . 40. (1992): 135-141.

U.S. Appl. No. 12/832,823, filed Jul. 8, 2010, Inventors: Chaitanya K. Vempati et al.

* cited by examiner

CUTTING ELEMENT AND METHOD OF FORMING THEREOF

CROSS-REFERENCE TO RELATED APPLICATION(S)

The present application claims priority from U.S. Provisional Patent Application No. 61/223,747, filed Jul. 8, 2009, entitled "Cutting Element and Method of Forming Thereof," which application is incorporated by reference herein in its entirety.

TECHINCAL FIELD

The following disclosure is directed to cutting elements for use in drill bits and/or milling bits, and particularly cutting elements incorporating a cutting body and a sleeve.

BACKGROUND

In the past, rotary drill bits have incorporated cutting elements employing superabrasive materials. Within the industry there has been widespread use of synthetic diamond cutters using polycrystalline diamond compacts, otherwise termed "PDC" cutters. Such PDC cutters may be self supported, otherwise a monolithic object made of the desired material, or incorporate a polycrystalline diamond layer or "table" on a substrate made of a hard metal material suitable for supporting the diamond layer.

However, PDC cutter designs continue to face obstacles. For example, mechanical strains are commonplace given the significant loading on the cutters, and as such, delamination and fracture of the cutters, particularly of the diamond table, can occur given the extreme loading and temperatures generated during drilling operations. Furthermore, failure of the cutters due to temperature concerns can go beyond the existence of simply encountering high temperatures. In addition, the effects of heating and cooling on the cutters and the resultant failure of the cutters is also due to differences in thermal expansion coefficient and thermal conductivity of materials within the cutter.

Various different configurations of cutters have been used to mitigate the effects of mechanical strain and temperature-induced wear characteristics. However, significant shortcomings are still exhibited by conventional cutters.

SUMMARY

According to one aspect a cutting element for use in a drilling bit and/or milling bit includes a cutter body comprising a substrate having an upper surface, and a superabrasive layer overlying the upper surface of the substrate. The cutting element further includes a sleeve extending around a portion of a side surface of the superabrasive layer and a side surface of the substrate, wherein the sleeve exerts a radially compressive force on the superabrasive layer.

In another aspect, a cutting element for use in a drilling bit and/or milling bit includes a cutter body having a substrate including an upper surface and a superabrasive layer overlying the upper surface of the substrate. The cutting element further includes a sleeve extending around a portion of a side surface of the superabrasive layer and a side surface of the substrate, wherein the sleeve has a coefficient of thermal expansion (CTE) that is different than a coefficient of thermal expansion (CTE) of the superabrasive layer.

In still another aspect, a cutting element for use in a drilling bit and/or milling bit includes a cutter body having a substrate including an upper surface and a superabrasive layer overlying the upper surface of the substrate. The cutting element further includes a sleeve in direct contact with and extending around a portion of a side surface of the superabrasive layer and a side surface of the substrate, wherein the sleeve comprises a modulus of elasticity (MOE) that is different than a MOE of the superabrasive layer.

According to another aspect, a cutting element for use in a drilling bit and/or milling bit includes a cutter body having a substrate including an upper surface and a superabrasive layer overlying the upper surface of the substrate, wherein the superabrasive layer comprises an upper surface, a rear surface, and a side surface extending between the upper surface and rear surface. Additionally, the cutting element includes a sleeve in direct contact with and extending around a portion of the side surface of the superabrasive layer.

Another aspect of the present application includes a method of forming a cutting element for use in a drilling bit and/or milling bit comprising forming cutter body including a substrate and a superabrasive layer overlying a surface of the substrate, forming a sleeve comprising a central opening, and fitting the cutter body within the central opening of the sleeve, wherein the sleeve exerts a radially compressive force on the cutter body.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to earth boring drilling bits and/or milling bits, and more particularly, cutting elements used in such bits. The following describes cutting elements and methods of forming such elements such that they may be incorporated within drilling and/or milling bits. The terms "bit", "drill bit", and "matrix drill bit" may be used in this application to refer to "rotary drag bits", "drag bits", "fixed cutter drill bits", "mill-and-drill-bits", "milling bits" or any bits incorporating the teachings of the present disclosure. As will be appreciated, such drill bits may be used to form well bores or boreholes in subterranean formations as well as mill through casings or other objects within a borehole.

Figure 1:
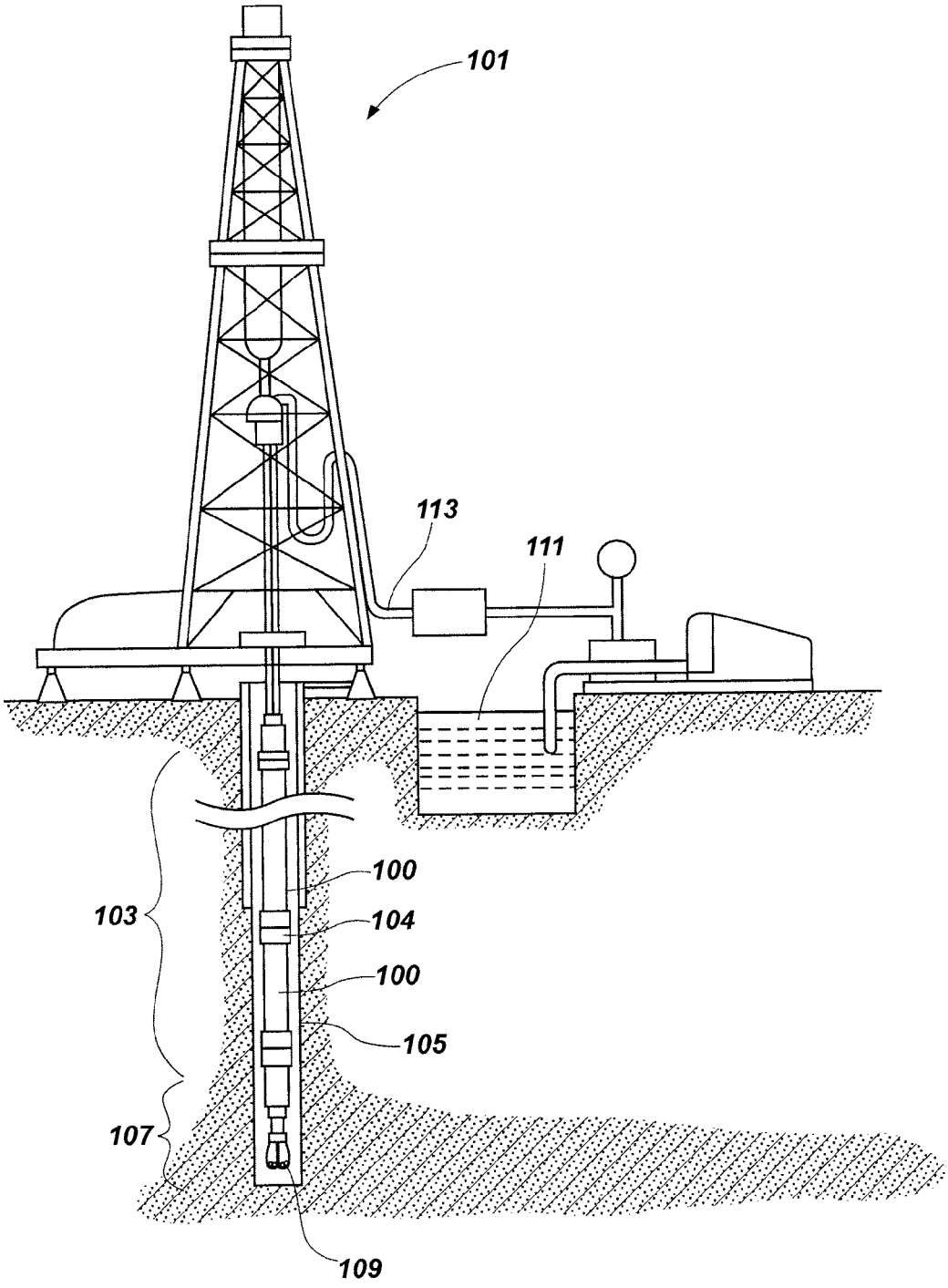
FIG. 1 includes an illustration of a subterranean drilling operation.

An example of a drilling system for drilling such well bores in earth formations is illustrated in FIG. 1. In particular, FIG. 1 illustrates a drilling system including a drilling rig 101 at the surface, serving as a station for workers to operate a drill string 103. The drill string 103 defines a well bore 105 extending into the earth and can include a series of drill pipes 100 that are coupled together via joints 104 facilitating extension of the drill string 103 for depths into the well bore 105. The drill string 103 may include additional components, such as tool joints, a kelly, kelly cocks, a kelly saver sub, blowout preventers, safety valves, and other components known in the art.

Moreover, the drill string 103 can be coupled to a bottom hole assembly (BHA) 107 including a drill bit 109 used to penetrate earth formations and extend the depth of the well bore 105. The BHA 107 may further include one or more drill collars, stabilizers, a downhole motor, MWD tools, LWD tools, jars, accelerators, push and pull directional drilling tools, point stab tools, shock absorbers, bent subs, pup joints, reamers, valves, and other components. A fluid reservoir 111 is also present at the surface that holds an amount of liquid that can be delivered to the drill string 103, and particularly the drill bit 109, via pipes 113, to facilitate the drilling procedure.

Figure 2:
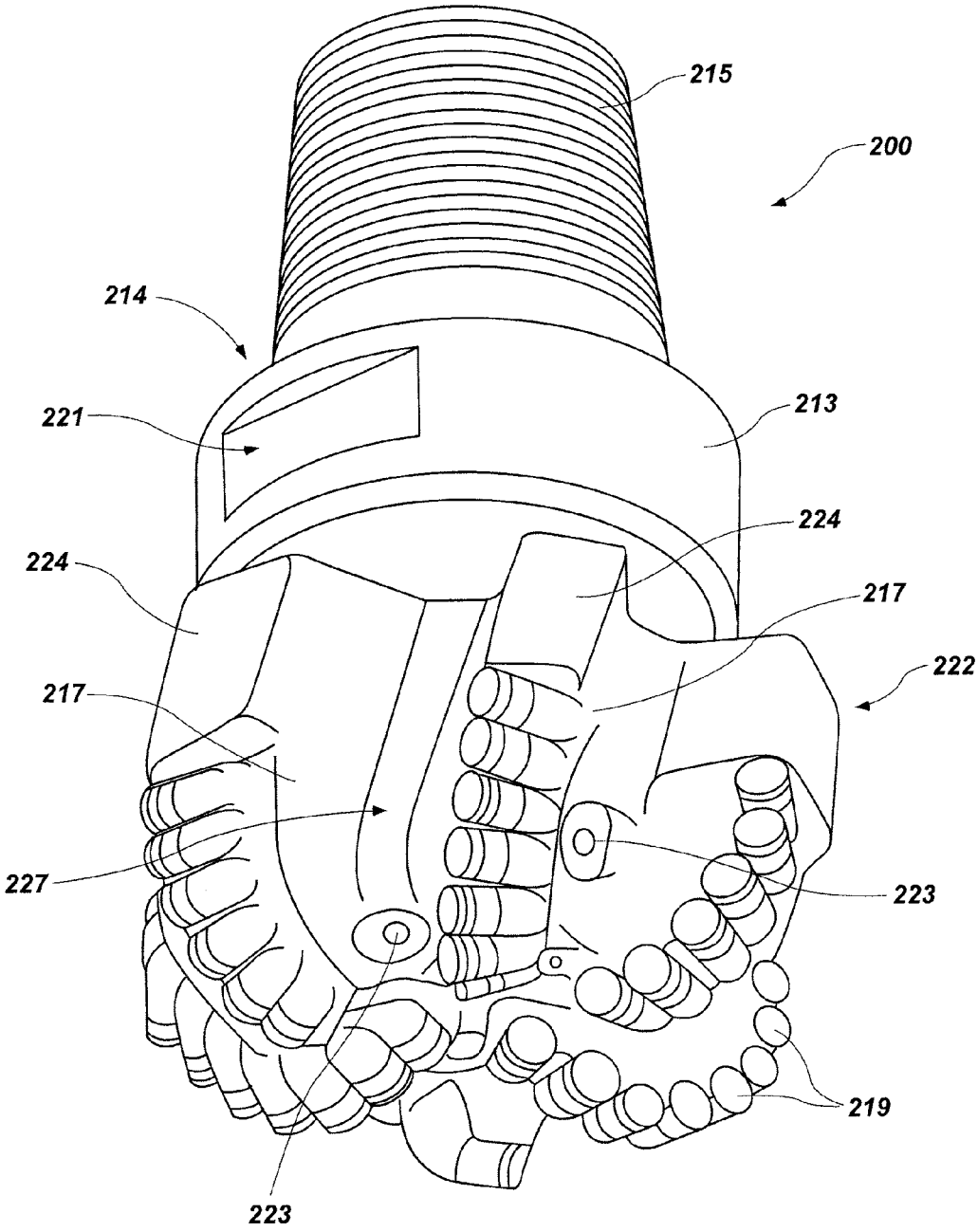
FIG. 2 includes an illustration of a drill bit in accordance with an embodiment.

FIG. 2 includes a perspective view of a fixed cutter drill bit according to an embodiment. The fixed cutter drill bit 200 has a bit body 213 that can be connected to a shank portion 214 via a weld. The shank portion 214 includes a threaded portion 215 for connection of the drill bit 200 to other components of the BHA 107, as shown in FIG. 1. The drill bit body 213 can further include a breaker slot 221 extending laterally along the circumference of the drill bit body 213 to aid coupling and decoupling of the drill bit 200 to other components.

The drill bit 200 includes a crown portion 222 coupled to the drill bit body 213. As will be appreciated, the crown portion 222 can be integrally formed with the drill bit body 213 such that they are a single, monolithic piece. The crown portion 222 can include gage pads 224 situated along the sides of protrusions or blades 217 that extend radially from the crown portion 222. Each of the blades 217 extend from the crown portion 222 and include a plurality of cutting elements 219 bonded to the blades 217 for cutting, scraping, and shearing through earth formations when the drill bit 200 is rotated during drilling. The cutting elements 219 may be polycrystalline diamond compacts (PDC) or any of the cutting elements described herein. Coatings or hardfacings may be applied to other portions of the bit body 213 or crown portion 222 to reduce wear and increase the life of the drill bit 200.

The crown portion 222 can further include junk slots 227 or channels formed between the blades 217 that facilitate fluid flow and removal of cuttings and debris from the well bore. Notably, the junk slots 227 can further include openings 223 for passages extending through the interior of the crown portion 222 and bit body 213 for communication of drilling fluid through the drill bit 200. The openings 223 can be positioned at exterior surfaces of the crown portion 222 at various angles for dynamic fluid flow conditions and effective removal of debris from the cutting region during drilling.

Figure 3A:
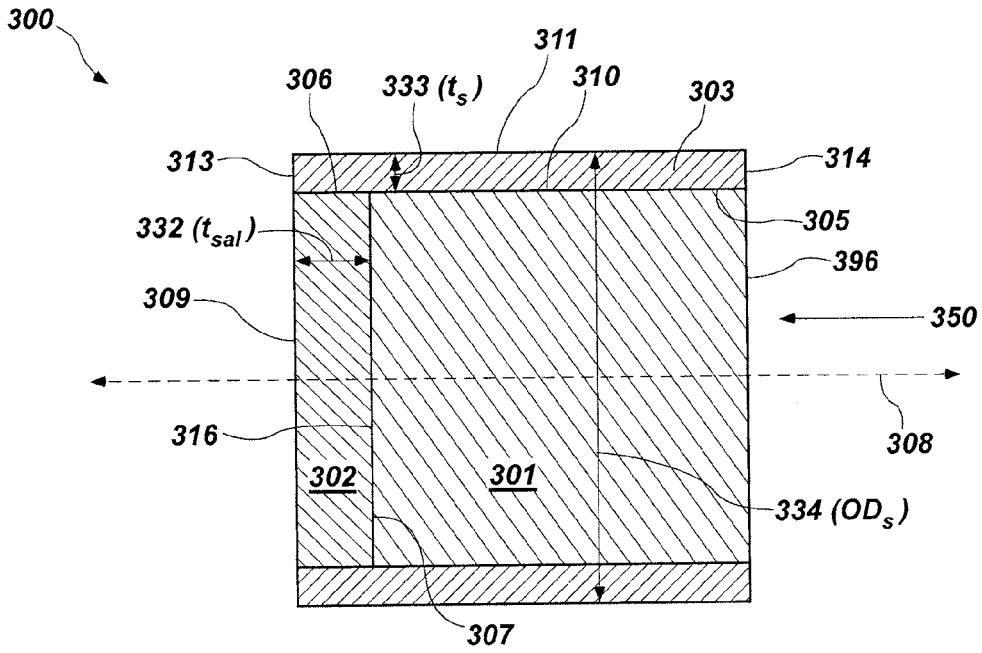
FIGS. 3A-3B include a cross-sectional illustrations and a perspective view illustration of a cutter element in accordance with an embodiment.
Figure 3B:
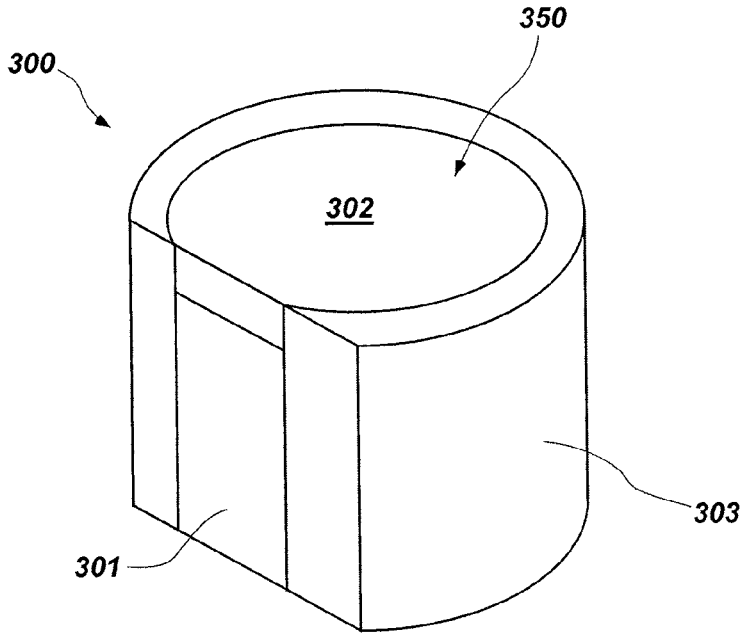

FIGS. 3A-3B include a cross-sectional illustration and a perspective view illustration of a cutting element in accordance with an embodiment. In particular, FIG. 3A includes a cross-sectional illustration of a cutting element employing a cutter body 350 and a sleeve 303 extending around a portion of the cutter body 350 in accordance with an embodiment. The cutter body 350 can include a substrate 301 having an upper surface 307 extending transversely to the longitudinal axis 308, a rear surface 396 parallel to the upper surface 307 and extending transversely to the longitudinal axis 308, and a side surface 305 extending between the upper surface 307 and rear surface 396 and extending parallel to the longitudinal axis 308. The substrate provides a support object for forming a superabrasive layer 302 thereon.

In reference to the substrate 301, the substrate 301 can be made of a material suitable for withstanding drilling applications. For example, the substrate 301 can employ a material having a Mohs hardness of at least about 8, or at least about 8.5, at least about 9.0, or even at least about 9.5. The substrate 301 can be formed of carbides, nitrides, oxides, borides, carbon-based materials, and a combination thereof. Particular metals or metal alloy materials may be incorporated in the substrate 301, such that the substrate 301 can be made of a cermet. In some instances, the substrate 301 can be made of a cemented material, such as a cemented carbide. Some suitable cemented carbides can include metal carbides, and particularly cemented tungsten carbide. According to one embodiment, the substrate 301 consists essentially of tungsten carbide.

The substrate 301 can have a shape comprising an elongated portion defining a length extending along a longitudinal axis 308. In certain designs, the side surface 305 of the substrate 301 can have an arcuate shape defining a circumference extending at a radius around the longitudinal axis 308. For instance, the substrate 301 may have a cylindrical shape, such that it has a circular cross-sectional contour as viewed in cross-section to the longitudinal axis 308. It will be appreciated that alternative shapes for the substrate 301 and cutting elements herein are possible, including polygonal cross-sectional contours (e.g., rectangular, trapezoidal, pentagonal, triangular, etc.), elliptical cross-sectional contours, hemispherical cross-sectional contours, and the like. Accordingly, it will be further appreciated that reference herein to a circumference with regard to the cutting element or any of its components is reference to a dimension extending around the periphery of the identified article in instances where the cutter has a cross-sectional contour other than that of a circle.

The cutter body 350 can include a superabrasive layer 302 overlying the upper surface 307 of the substrate 301. In particular, the superabrasive layer 302 can be in direct contact with (i.e., abutting) the upper surface 307, and more particularly, bonded directly to the upper surface 307 of the substrate 301. In certain designs, the superabrasive layer 302 can be formed such that it has a rear surface 316 forming an interface with the upper surface 307 of the substrate 301 extending transversely to the longitudinal axis 308. The superabrasive layer 302 can have an upper surface 309 parallel to the rear surface 316 and extending transversely to the longitudinal axis 308. A side surface 306 of the substrate 301 can extend between the rear surface 316 and upper surface 309 parallel to the longitudinal axis 308 of the cutter body 350.

The superabrasive layer 302 can include superabrasive materials such as diamond, boron nitride (e.g., cubic boron nitride), certain carbon-based materials, and a combination thereof. Some superabrasive layers may be in the form of polycrystalline materials. For instance, the superabrasive layer 302 can consist essentially of polycrystalline diamond. With reference to those embodiments using polycrystalline diamond, the superabrasive layer 302 can be made of various types of diamond including thermally-stable polycrystalline diamond, which generally contain a lesser amount of catalyst materials (e.g., cobalt) than other diamond materials, making the material stable at higher temperatures. In other applications, the superabrasive layer 302 can be formed such that it consists essentially of polycrystalline cubic boron nitride.

In some embodiments, the superabrasive layer 302 has a thickness 332 ($t_{sal}$) measured in a direction substantially parallel to the longitudinal axis 308 of the cutter body 350. The superabrasive layer 302 can have a volume and average thickness 332 ($t_{sal}$) suitable for operating in combination with other components (e.g., a sleeve 303) for improved performance. Generally, the superabrasive layer 302 may have a thickness 332 ($t_{sal}$) of at least about 0.5 mm, such as at least about 1 mm, at least about 2 mm, at least about 3 mm or even at least about 4 mm. In certain exemplary designs, the superabrasive layer 302 has a thickness 332 ($t_{sal}$)within a range between about 0.5 mm and about 5 mm.

As further illustrated in FIG. 3A, the cutting element 300 can include a sleeve 303 extending around a portion of the side surface 306 of the superabrasive layer 302 and the side surface 305 of the substrate 301. As illustrated, the sleeve 303 comprises an inner surface 310 extending substantially parallel to the longitudinal axis 308, and an outer surface 311, opposite the inner surface 310, extending substantially parallel to the longitudinal axis 308. Additionally, the sleeve 303 can have an upper surface 313 and a rear surface 314, each of which can extend between the inner surface 310 and outer surface 311, parallel to each other and in a direction substantially perpendicular to the longitudinal axis 308 of the cutter body 350.

The inner surface 310 defines a central opening wherein the cutter body 350 can be disposed. In particular, the sleeve 303 can be formed such that the inner surface 310 is in direct contact with the side surface 306 of the superabrasive layer 302. In particular designs, the sleeve 303 is formed such that the inner surface 310 is directly bonded to the side surface 306 of the superabrasive layer 302. Likewise, the sleeve 303 can be formed such that the inner surface 310 is directly contacting the side surface 305 of the substrate 301. For example, in some designs, the inner surface 310 of the sleeve 303 can be directly bonded to the side surface 305 of the substrate 301.

The sleeve 303 can extend along certain portions of the length (i.e., parallel to the longitudinal axis 308) the cutter body 350. In particular designs, the sleeve 303 extends along at least 50% of the total thickness 332 ($t_{sal}$) of the superabrasive layer 302 between the rear surface 316 and the upper surface 309. In other embodiments, the sleeve 303 is designed to extend over a greater portion of the thickness 332 ($t_{sal}$) of the superabrasive layer 302, such as at least about 60%, at least about 75%, at least about 80%, and even at least about 90%. According to one particular embodiment, the sleeve 303 is formed to extend along the entire thickness 332 ($t_{sal}$) of the superabrasive layer 302. Notably, in such embodiments, the sleeve 303 can be formed such that the upper surface 313 of the sleeve 303 is coplanar with the upper surface 309 of the superabrasive layer 302.

Generally, the sleeve 303 is formed to extend along the entire length of the inner surface 305 of the substrate 303. However, it will be appreciated that certain embodiments may utilize a sleeve 303 extending for a fraction of the full length of the substrate 301 along the longitudinal axis 308.

The sleeve 303 can be formed such that it extends peripherally (e.g., circumferentially) along the side surfaces 306 and 305 of the superabrasive layer 302 and substrate 301, respectively. The amount of peripheral coverage of the sleeve can be measured in degrees of coverage based on a central angle measured perpendicular to the longitudinal axis 308 and centered at the center of the cutter body 350 defined by the longitudinal axis 308. According to some designs, the sleeve 303 can extend through the entire periphery (i.e., 360° of coverage) of the cutter body 350. That is, the sleeve 303 is a single, monolithic piece extending around the entire circumference of the side surface 306 of the superabrasive layer 302 and the side surface 305 of the substrate 301.

Alternatively, some cutting elements can incorporate a sleeve 303 formed of discrete sleeve portions, wherein each discrete sleeve portion extends through a fraction of the total peripheral distance of the cutter body 350. For example, a sleeve portion can extend through not greater than 270°, such as not greater than 180°, such as not greater than 90°, or even not greater than 45° of the total peripheral distance of the cutter body 350. The discrete sleeve portions can be mechanically attached to each other, such as in an interlocking arrangement, through overlapping lips, grooved connections, and the like. In other designs, the discrete sleeve portions may be bonded to each other, such as through the use of a brazing composition.

In accordance with embodiments herein, the cutting element 300 is formed such that the sleeve 303 can exert a radially compressive force on the superabrasive layer 302. Notably, the sleeve 303 is formed and oriented with respect to the superabrasive layer 302 such that it exerts a radially compressive force at the side surface 306 of the superabrasive layer 302. Accordingly, the forces exerted by the sleeve 303 on the superabrasive layer 302 are provided in a manner such that a significant portion of the force, or even a majority of the force, or even entirely all of the force applied by the sleeve 303 is a radially compressive force acting in a direction substantially perpendicular to the longitudinal axis 308 of the cutter body 350 at the side surface 306 of the superabrasive layer 302.

The cutting element 300 is formed in a manner such that the sleeve 303 can also exert a radially compressive force on the substrate 301. The sleeve 303 can be oriented with respect to the substrate 301 such that the sleeve 303 exerts a radially compressive force on the substrate 301 at the side surface 305 of the substrate 301. In particular, a significant portion of the force applied, or even a majority of the total force applied, and in some cases, entirely all of the force applied by the sleeve 303 on the substrate may be a radially compressive force acting on the side surface 305 of the substrate 301 in a direction substantially perpendicular to the longitudinal axis 308 of the cutter body 350.

Notably, embodiments herein utilize a sleeve 303 which can have a particular shape such that the compressive forces exerted on the superabrasive layer 302 and the substrate 301 are suitable for performance of the cutting element 300. In particular, the sleeve 303 can be formed such that is has an average thickness 333 ($t_s$) as measured in a direction perpendicular to the longitudinal axis 308 between the inner surface 310 and the outer surface 311 of the sleeve 303 that is not greater than about 5 mm. According to other embodiments, the sleeve 303 can have an average thickness 333 ($t_s$) that is at least about 0.1 mm, such as at least about 0.5 mm, at least about 1 mm, at least about 2 mm, or even at least about 3 mm. Still, certain embodiments utilize a sleeve 303 having an average thickness 333 ($t_s$) that is not greater than about 5 mm, on the order of not greater than about 4 mm, such that it is not greater than about 3 mm, or even not greater than about 2 mm. More particular designs may utilize an average sleeve thickness 333 ($t_s$) within a range between about 0.1 mm and about 5 mm, such as between about 1 mm and about 4 mm, such as between about 1 mm and about 3 mm, or even between about 2 mm and about 3 mm.

The sleeve 303 may be formed to have a particular outer diameter 334 ($OD_s$), which when combined with a particular thickness 333 ($t_s$)of the sleeve 303 provides suitable compressive forces on the superabrasive layer 302. such that the sleeve 303 exerts suitable forces on the superabrasive layer 302. In particular embodiments, the sleeve 303 can be formed to have an outer diameter 334 ($OD_s$) within a range between 8 mm to about 25 mm.

Certain cutting elements utilize a sleeve 303 including a metal or metal alloy material. The metal or metal alloy materials can include transition metal elements. Examples, of some suitable metal elements for use in the sleeve 303 can include titanium, chromium, nickel, tungsten, cobalt, irons, molybdenum, vanadium, and a combination thereof. In certain embodiments, it may be suitable to form a sleeve 303 comprising a superalloy material, which is a refractory metal or metal alloy having superior hardness, and which typically incorporates metal elements such as tungsten, chromium, cobalt, iron, and nickel. Some such suitable superalloys can include nickel-based materials, cobalt-based materials, chromium-based material, and/or cobalt-chromium-based materials.

Additionally, the sleeve 303 can be made of a material such as a carbide, a nitride, a boride, an oxide, a carbon-based material, and a combination thereof. In accordance with one particular embodiment, the sleeve 303 is a cermet material. Particular examples of suitable cermet materials include tungsten carbide material or cemented tungsten carbide.

Still, some cutting elements can be formed such that sleeve 303 is made of the same material as the substrate 301. That is, in some designs, the sleeve 303 and substrate 301 can be made of exactly the same composition. Still, in other embodiments, the sleeve 303 and the substrate 301 may be formed such that they comprise a different material. For example, the sleeve 303 and substrate 301 may be carbides, however, the sleeve 303 may be formed of a carbide having a different composition than that of the substrate 301. That is, the sleeve 303 can be formed such that it contains a different element, such as a different metal species. In still other embodiments, the sleeve 303 can be made from a completely different material having an entirely distinct composition than that of the substrate 301.

Referring to FIG. 3B, a perspective illustration of the cutting element of FIG. 3A is provided with a cut-out portion for an internal view of components of the cutting element. FIG. 3B provides a fuller understanding of the orientation of the components of the cutting element 300 with respect to each other, with a cut-out portion for an appreciation of the orientation of the substrate 301 and the superabrasive layer 302. As illustrated, the sleeve 303 can surround the cutter body 350 including the substrate 301 and the superabrasive layer 302. As described herein, and as will be appreciated, while FIG. 3B illustrates a cutting element 300 having a generally cylindrical shape, but other polygonal shapes are contemplated, such as elliptical, triangular, rectangular, trapezoidal, hexagonal, irregular, and the like.

Figure 4:
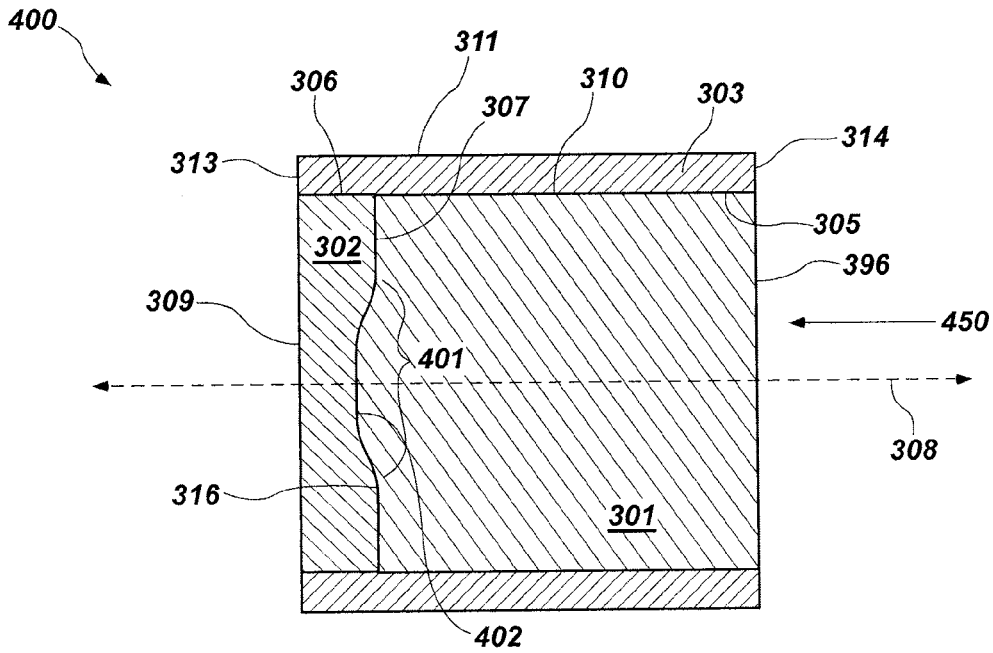
FIG. 4 includes a cross-sectional illustration of a cutter element in accordance with an embodiment.

FIG. 4 includes a cross-sectional illustration of a cutting element in accordance with an embodiment. The cutting element 400 includes components described herein, particularly including a cutter body 450 comprising a substrate 301 and a superabrasive layer 302 overlying an upper surface 307 of the substrate 301. The cutting element 400 further includes a sleeve 303 extending over the side surface 306 of the superabrasive layer 302 and the side surface 305 of the substrate 301. Notably, the upper surface 307 of the substrate 301 is formed to have a contoured region 401. The contoured region 401 can be formed in the upper surface 307 to aid reduction of stresses in the superabrasive layer 302. The contoured region 401 can be formed such that it includes a protrusion 402 extending axially along the longitudinal axis 308 and displaced at a position along the longitudinal axis 308 that is different than other points along the upper surface 307. It will be appreciated, that the contoured region 401 is illustrated as including a protrusion 402, but other shapes and contours may be used. For example, a series of protrusions or series of grooves may be utilized, and moreover, patterned of shapes may be utilized on the upper surface 307, such as an arrangement of protrusions appearing as spokes extending radially along the upper surface 307 of the substrate 301 from the center of the upper surface 307 to the side surface 306 of the substrate 301.

FIGS. 5A-5G include cross-sectional illustrations of cutting elements according to embodiments, In particular, the FIGS. 5A-5G include illustrations of embodiments using a sleeve having a variable thickness that can have a changing thickness with a change in position in an axial direction, a change in position in a radial direction, or a combination of such directions. The thickness of the sleeve can be a gradual variation (e.g., a tapered form), an abrupt variation (e.g., a stepped configuration), a series of discrete, abrupt variations, or a combination thereof. The thickness of the sleeve can be varied such that the change in thickness is asymmetric. The asymmetry can be based around the longitudinal axis, a radial axis, or a combination thereof. For example, the inner and outer surfaces of the sleeve can be varied such that the change in thickness is asymmetric with regard to the contours of the inner and outer surfaces. Such designs facilitate securing the sleeve and cutter body together, securing the cutting element to the drill bit body, improved performance of the cutting element, and providing varied, and controlled, forces (e.g., radially compressive forces, axial forces, etc.) exerted by the sleeve on different portions of the cutter body.

Figure 5A:
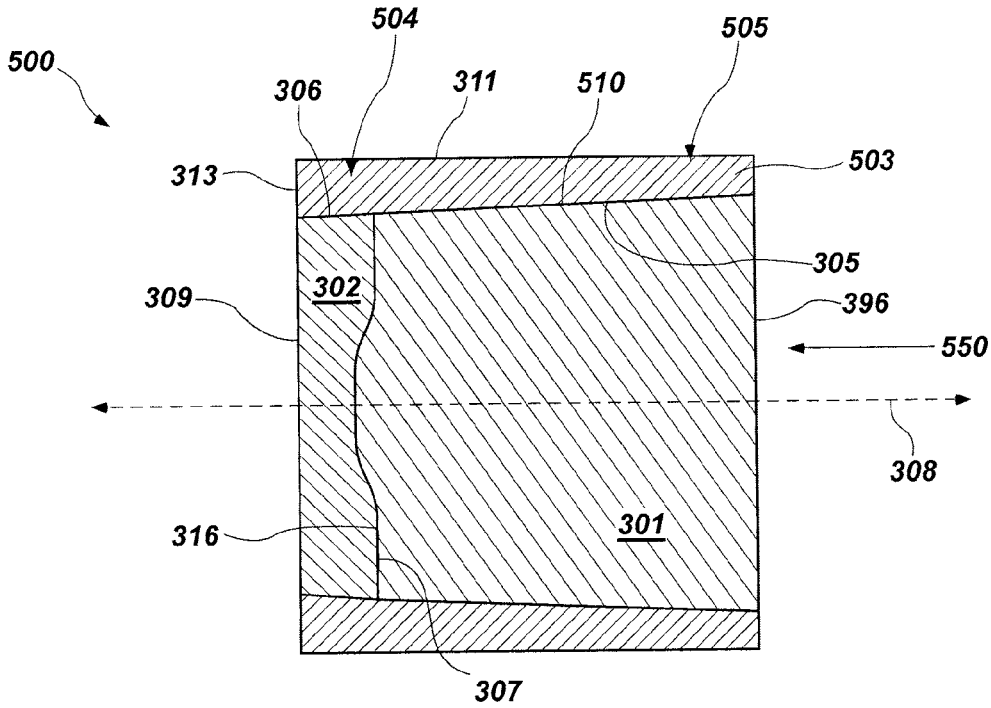
FIGS. 5A-5G include cross-sectional illustrations of cutter elements in accordance with an embodiment.

FIG. 5A includes a cross-sectional illustration of a cutting element in accordance with an embodiment. The cutting element 500 includes a cutter body 550 employing a substrate 301 having a superabrasive layer 302 overlying the upper surface 307 of the substrate 301. The cutting element 500 further includes a sleeve 503 overlying a side surface 306 of the superabrasive layer 302 and a side surface 305 of the substrate 301. Generally, cutting elements of any of the embodiments herein can be formed such that the sleeve can have a thickness as measured between the inner surface 510 and the outer surface 311 that varies. That is, the thickness of the sleeve 503 can vary in an axial direction, a radial direction, or a combination thereof.

As illustrated in FIG. 5A, the sleeve 503 is formed such that its thickness varies axially, changing in thickness at different positions along the longitudinal axis 308 of the cutter body 550. In particular embodiments, the sleeve 503 can have a tapered shape, such that the thickness of the sleeve 503 within the region 504 adjacent to the superabrasive layer 302 has a greater thickness than the thickness of the sleeve 503 within region 505 adjacent to the rear surface 396 of the substrate 301. The provision of the sleeve 503 having a variable thickness, can facilitate a difference in the forces exerted at different locations along the cutter body 550. For example, in the embodiment of FIG. 5A, the radially compressive forces exerted by the sleeve 503 on the superabrasive layer 302 may be greater than the radially compressive forces exerted by the sleeve 503 in region 505.

Figure 5B:
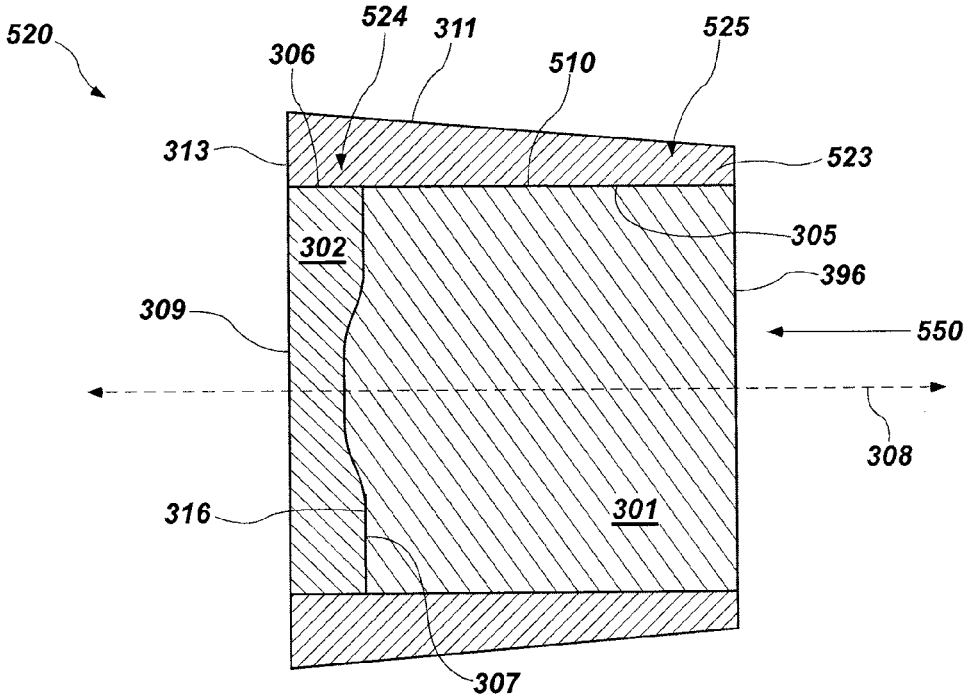

FIG. 5B includes a cross-sectional illustration of a cutting element in accordance with an embodiment. Cutting element 520 includes a cutter body 550 employing a substrate 301 having a superabrasive layer 302 overlying the upper surface 307 of the substrate 301. The cutting element 520 includes a sleeve 523 overlying a side surface 306 of the superabrasive layer 302 and a side surface 305 of the substrate 301. According to the illustrated embodiment, the sleeve 523 has a variable thickness achieved by using a tapered surface for the outer surface 311 that extends in a non-parallel direction to the inner surface 510 of the sleeve 523. That is, the inner surface 510 can be formed such that it extends parallel to the longitudinal axis 308 of the cutter body 550, but the outer surface 311 of the sleeve 523 is angled relative to the longitudinal axis 308 of the cutter body 550. In certain embodiments, as illustrated in FIG. 5B, the outer surface 311 of the sleeve 523 can be tapered such that the sleeve 523 has a greater thickness within the region 524 adjacent the superabrasive layer 302 as compared to the thickness of the sleeve 523 within the region 525 adjacent to the rear surface 396 of the substrate 301. It will be appreciated, that other embodiments can be utilized wherein the thickness of the sleeve 523 varies in a different manner, for example, a sleeve wherein the thickness is greater in the region 525 as compared to the thickness of the sleeve in the region 524.

Figure 5C:
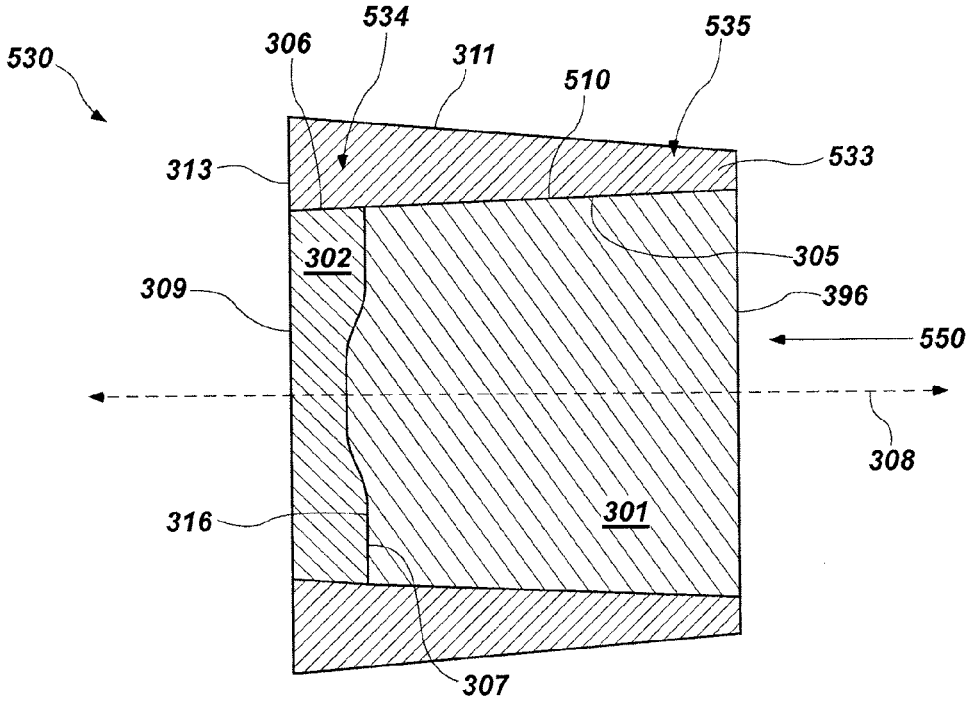

FIG. 5C includes a cross-sectional illustration of a cutting element in accordance with an embodiment. The cutting element 530 includes a cutter body 550 employing a substrate 301 having a superabrasive layer 302 overlying the upper surface 307 of the substrate 301. The cutting element 530 includes a sleeve 533 overlying a side surface 306 of the superabrasive layer 302 and a side surface 305 of the substrate 301. According to the embodiment of FIG. 5C, the sleeve 523 has a variable thickness achieved by using a tapered outer surface 311 that extends at an angle to the longitudinal axis 308 of the cutter body 550 and a tapered inner surface 510 that extends at an angle to the longitudinal axis 308 of the cutter body 550. In the particular embodiment illustrated, the sleeve 533 can have a variable thickness, wherein the sleeve 533 has a greater thickness in the region 534 as compared to the thickness of the sleeve 533 in the region 535. It will be appreciated that other embodiments can be utilized wherein the thickness of the sleeve 533 varies in a different manner, for example, a sleeve wherein the thickness is greater in the region 535 as compared to the thickness of the sleeve in the region 534.

Figure 5D:
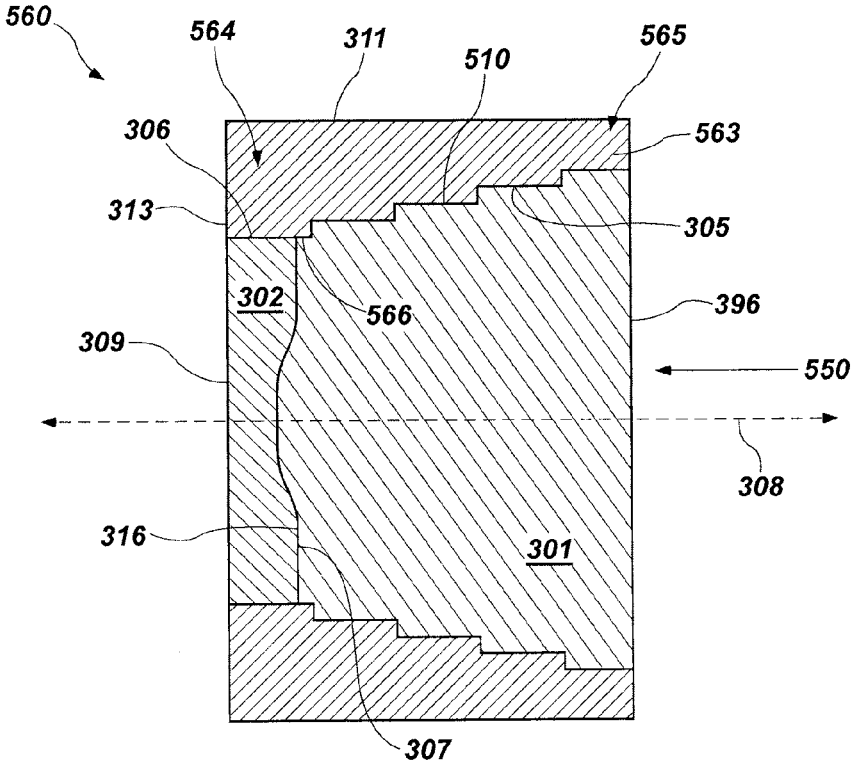

FIG. 5D includes a cross-sectional illustration of a cutting element in accordance with an embodiment. Cutting element 560 includes a cutter body 550 employing a substrate 301 having a superabrasive layer 302 overlying the upper surface 307 of the substrate 301. The cutting element 560 includes a sleeve 563 overlying a side surface 306 of the superabrasive layer 302 and a side surface 305 of the substrate 301. According to the embodiment of FIG. 5D, the sleeve 563 has a variable thickness that changes thickness at different axial positions along the longitudinal axis 308 at discrete intervals. As such, the sleeve 563 comprises an inner surface 510 having a stepped configuration including a plurality of discrete steps, wherein each of the steps comprise a different axial and radial position relative to each other and the sleeve 573 comprises a difference in thickness at each of the discrete steps. The illustrated embodiment of FIG. 5D utilizes a sleeve 563 having a greater thickness in region 564 as compared to the thickness of the sleeve 563 in the region 565.

The substrate 301 can be formed, either through a direct forming process (such as casting or molding) or by machining to have a side surface 305 having a complementary contour to the inner surface 510 of the sleeve 563. That is, the substrate 301 can have a side surface 305 comprising a plurality of steps for complementary engagement with the inner surface 510 of the sleeve 563. Such a design can facilitate an interlocking relationship between the two components.

It will be appreciated that other embodiments can be utilized wherein the thickness of the sleeve 563 varies in a different manner, for example, a sleeve wherein the thickness is greater in the region 565 as compared to the thickness of the sleeve in the region 564.

Figure 5E:
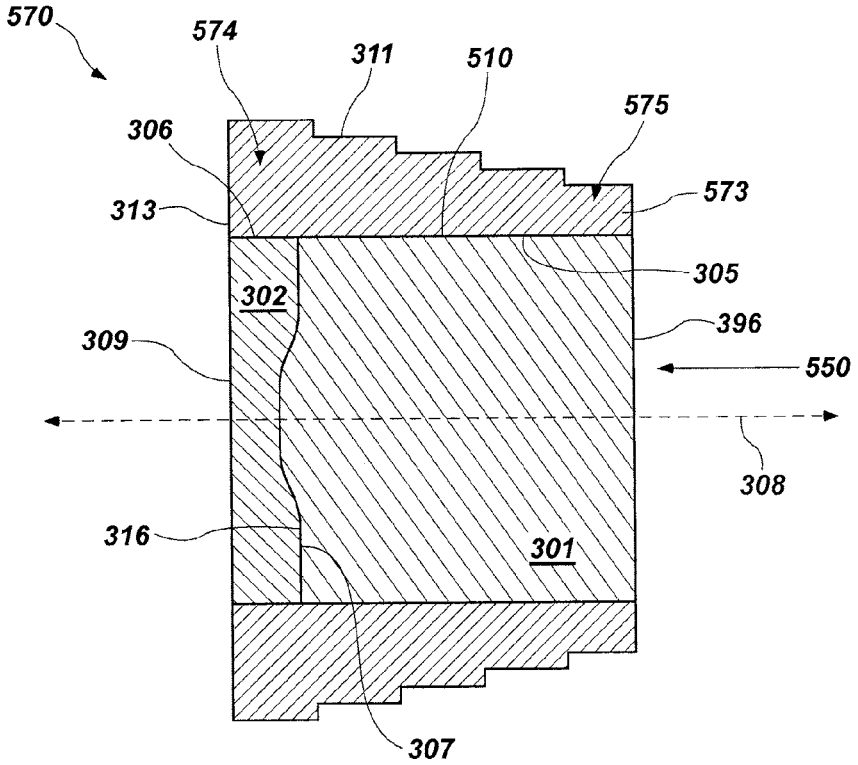
Figure 5F:
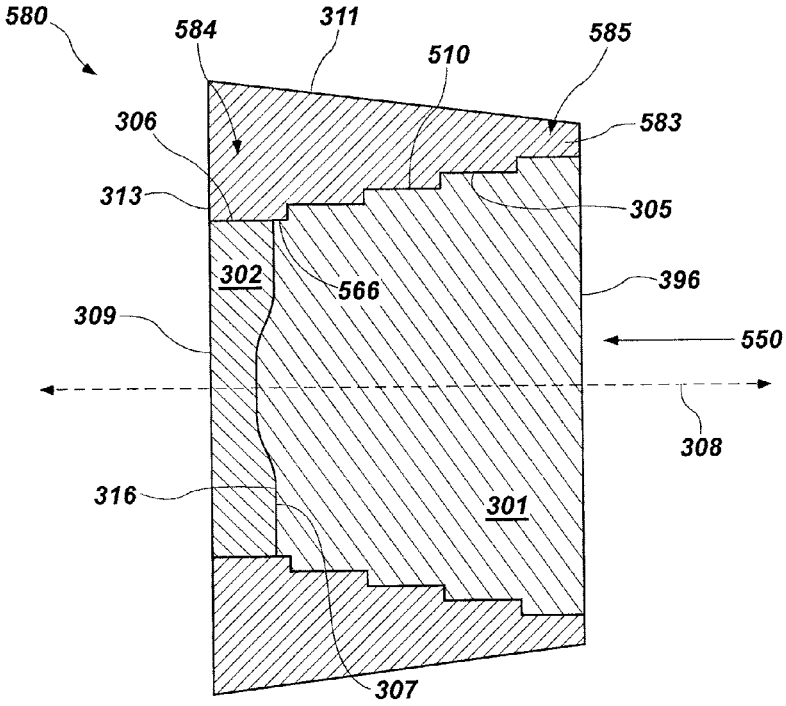
Figure 5G:
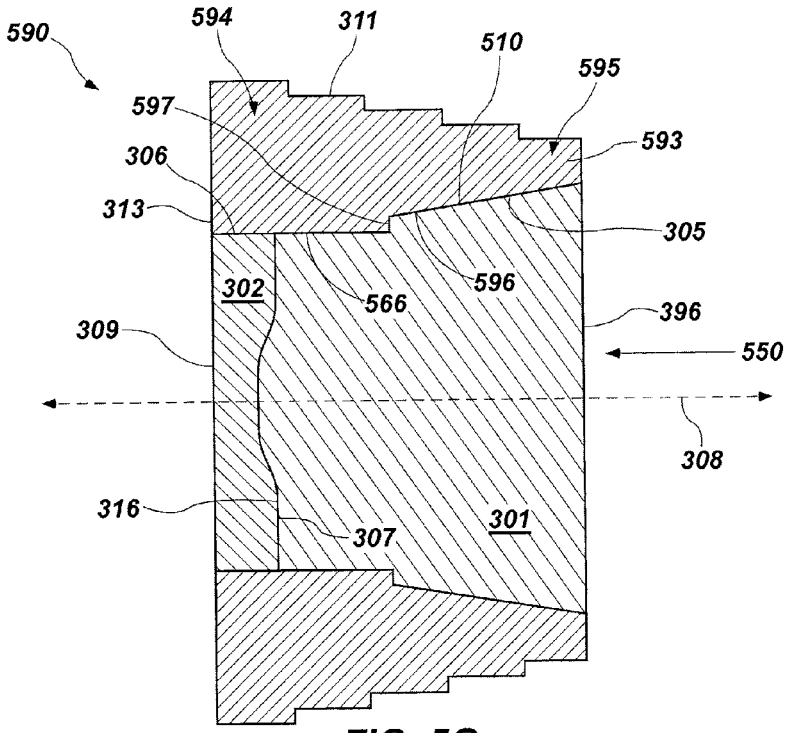

In particular embodiments, the sleeve 563 can have a first step 566 (as shown in FIGS. 5D, 5F, and 5G) defining the portion of the sleeve 563 having the greatest thickness. Notably, the step 566 extends for an axial length beyond the thickness of the superabrasive layer 302. Such a design facilitates formation of a side surface 306 of the superabrasive layer 302 that does not necessarily have to include a variable thickness. Such a design can facilitate ease of processing and formation of the cutting element.

It will be appreciated that while the illustrated embodiments demonstrates a symmetrical, stepped configuration for the inner surface 510 of the sleeve 563, other contours may be utilized. For example, the inner surface 510 can include steps of different radial height, axial length, and a combination thereof.

FIG. 5E includes a cross-sectional illustration of a cutting element in accordance with an embodiment. The cutting element 570 includes a cutter body 550 employing a substrate 301 having a superabrasive layer 302 overlying the upper surface 307 of the substrate 301. The cutting element 570 includes a sleeve 573 overlying a side surface 306 of the superabrasive layer 302 and a side surface 305 of the substrate 301. Notably, the sleeve 573 can comprise an outer surface 311 having a stepped configuration including a plurality of discrete steps, wherein each of the steps comprise a different axial and radial position relative to each other and the sleeve 573 comprises a difference in thickness at each of the discrete steps. The illustrated embodiment of FIG. 5E utilizes a sleeve 573 having a greater thickness in the region 574 as compared to the thickness of the sleeve 573 in the region 575. In such embodiments, the substrate 301 does not necessarily need to be formed to have a complementary, stepped inner surface. Moreover, the plurality of discrete steps can be suitable for securing the cutting element 570 within the drill bit body.

FIG. 5F includes a cross-sectional illustration of a cutting element in accordance with an embodiment. The cutting element 580 includes a cutter body 550 employing a substrate 301 having a superabrasive layer 302 overlying the upper surface 307 of the substrate 301. The cutting element 580 includes a sleeve 583 overlying a side surface 306 of the superabrasive layer 302 and a side surface 305 of the substrate 301 that incorporates a combination of a tapered surface and stepped surface. Notably, the sleeve 583 can include an outer surface 311 having a tapered contour extending axially at an angle to the longitudinal axis 308 of the cutter body 550. Moreover, the inner surface 510 of the sleeve 583 is formed to include a plurality of discrete steps, wherein each of the steps comprise a different axial and radial position relative to each other and the sleeve 583 comprises a difference in thickness at each of the discrete steps. The illustrated embodiment of FIG. 5F utilizes a sleeve 583 having a greater thickness in the region 584 as compared to the thickness of the sleeve 583 in the region 585.

FIG. 5G includes a cross-sectional illustration of a cutting element in accordance with an embodiment. Cutting element 590 includes a cutter body 550 employing a substrate 301 having a superabrasive layer 302 overlying the upper surface 307 of the substrate 301. The cutting element 590 includes a sleeve 593 overlying a side surface 306 of the superabrasive layer 302 and a side surface 305 of the substrate 301 that incorporates a combination of a tapered surface and stepped surface. In fact, the inner surface 510 of the sleeve 593 comprises a combination of a stepped surface and a tapered surface. As illustrated, the inner surface 510 of the sleeve 593 is formed to include a plurality of discrete steps, wherein each of the steps comprise a different axial and radial position relative to each other and the sleeve 593 comprises a difference in thickness at each of the discrete steps. In fact, the inner surface 510 comprises a first step 566 that extends along the side surface 306 of the superabrasive layer 302 and a portion of the side surface 305 of the substrate 301. The first step 566 extends generally parallel to the longitudinal axis 308 of the cutter body 550. The inner surface 510 further comprises another portion including a vertical surface 597 joining the first step 566 with a tapered step surface 596 which extends axially at an angle to the longitudinal axis 308 toward the rear surface 396 of the substrate 301.

Moreover, the cutting element 590 includes an outer surface 311 of the sleeve 593 that comprises a plurality of discrete steps, wherein each of the steps comprise a different axial and radial position relative to each other and each of the steps defines an abrupt change in the thickness of the sleeve 593. As illustrated, the sleeve 593 has a greater thickness in the region 594 as compared to the thickness of the sleeve 593 in the region 595. As contemplated by embodiments herein, the inner surface 510 and the outer surface 311 of the sleeve 593 can be formed such that the surfaces 510, 311 have different contours relative to each other to control the forces exerted by the sleeve 593 on the substrate 301 at different axial and radial positions.

Generally, cutting elements of embodiments herein can utilize a sleeve and a cutter body that are mechanically interlocked with each other. In particular instances, the sleeve can be formed such that it can be mechanically interlocked with the substrate. Mechanically interlocking connections between the cutter body and the sleeve can be accomplished by incorporation of interfacial surface features on the inner surface of the cutter body, particularly the substrate, and/or the sleeve. Notably, such interfacial features can include the use of complementary engaging features that are designed to interlock the sleeve and cutter body at the interface between the sleeve and cutter body. Some suitable examples of interfacial surface features can include grooves and/or protrusions extending axially and/or radially along the inner surface of the sleeve and cutter body, honeycomb structures, threaded surfaces, and the like.

Figure 6:
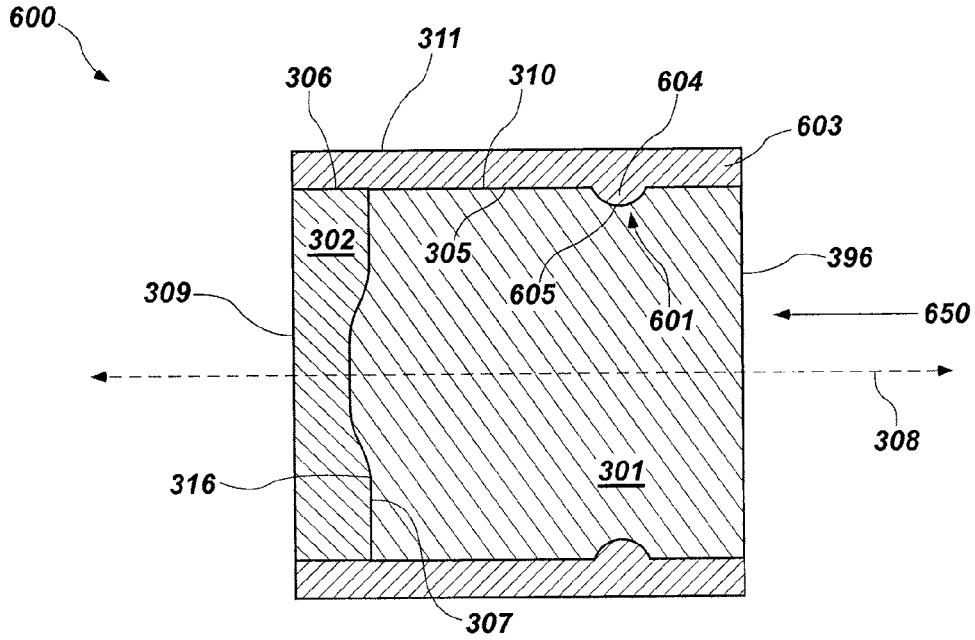
FIG. 6 includes a cross-sectional illustration of a cutter element in accordance with an embodiment.

One such design of mechanically interlocking orientation between the components is provided in FIG. 6. FIG. 6 includes a cross-sectional illustration of a cutting element in accordance with an embodiment. The cutting element 600 includes a cutter body 650 comprising a substrate 301 and a superabrasive layer 302 overlying an upper surface 307 of the substrate 301. A sleeve 603 extends over the side surface 306 of the superabrasive layer 302 and the side surface 305 of the substrate 301.

According to one embodiment, the sleeve 603 and the substrate can include a contoured region 601 along their respective inner surfaces 310 and 305 for complementary engagement and mechanically interlocking the two components. Contoured region 601 can include protrusions, grooves, lips, or any other surface features suitable for interlocking engagement between the sleeve 603 with the substrate 301. As illustrated in FIG. 6, the sleeve 603 comprises a protrusion 604 extending radially inward along the inner surface 310 that is configured to be engaged with a complementary groove 605 within the side surface 305 of the substrate 301. As will be appreciated, the protrusion 604 may extend for a portion of the peripheral (e.g. circumferential) dimension of the inner surface 310 of the sleeve 603. That is, the protrusion 604 may extend peripherally along the inner surface 310 of the sleeve 603 for a distance of at least about 45°, at least about 90°, or even at least about 180°. In certain instances, the protrusion 604 may extend for the full peripheral dimension of the inner surface 310 of the sleeve 603 (i.e., 360°). Likewise, the complementary groove 605 may extend for the same distance for proper complementary engagement of the groove 605 therein.

Figure 7A:
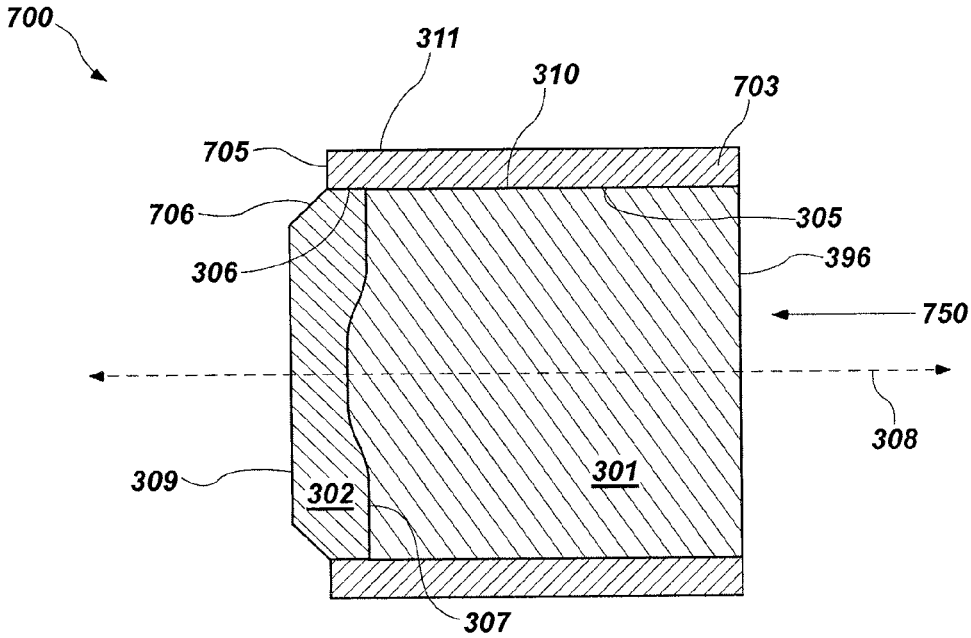
FIGS. 7A-7D include cross-sectional illustrations of cutter elements in accordance with embodiments.

FIGS. 7A-7D include cross-sectional illustrations of cutting elements in accordance with embodiments. FIG. 7A includes a cross-sectional illustration of a cutting element 700 including a cutter body 750 employing a substrate 301 and a superabrasive layer 302 overlying an upper surface 307 of the substrate 301. Additionally, the cutting element 700 includes a sleeve 703 that extends over the side surface 306 of the superabrasive layer 302 and the side surface 305 of the substrate 301. Notably, the cutter body 750 is formed such that the superabrasive layer 302 comprises a chamfered surface 706 extending at an angle to the longitudinal axis 306 of the cutter body 750 and located between the upper surface 309 and side surface 306 of the superabrasive layer 302.

The chamfered surface 706 can improve the cutting performance of the cutting element 700. Various angles and lengths of the chamfered surface 706 may be employed. As will be appreciated, the chamfered surface 706 may extend as an annulus around the entire periphery of the superabrasive layer 302. However, the chamfered surface 706 may be segmented, such that it is made of discrete portions, wherein each portion extends for a distance less than the entire periphery (i.e., less than 360°). Moreover, in certain instances, it may be desirable to use a radiused edge as opposed to a chamfered surface. A radiused edge can have a curvature or arcuate shape that can be defined by a radius. As such, it will be appreciated that references herein to chamfered surfaces will be understood to also include radiused edge configurations.

As further illustrated, the sleeve 703 of the cutting element 700 is oriented such that it overlies the side surface 306 of the superabrasive layer 302. The sleeve 703 is formed such that it includes an upper surface 705 that extends perpendicular to the longitudinal axis 308 of the cutter body 750. Notably, the sleeve 703 is placed around the cutter body 750 such that an upper surface 705 of the sleeve 703 abuts and extends from the joint between the chamfered surface 706 and side surface 306 of the superabrasive layer 302. At least a portion of the sleeve 703 overlies the side surface 306, and in particular, is abutting the side surface 306 of the superabrasive layer 302.

Figure 7B:
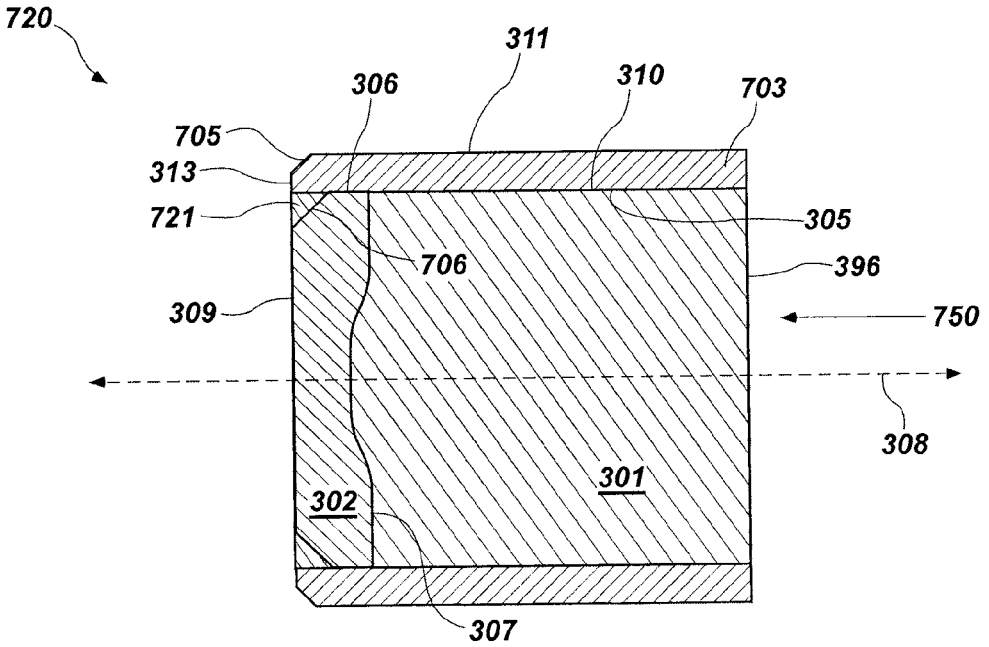

FIG. 7B includes a cross-sectional illustration of a cutting element in accordance with an embodiment. Notably, the cutting element 720 includes some of those components described in the embodiment of FIG. 7A. In addition to the chamfered surface 706 of the superabrasive layer 302, the cutting element 720 further includes an arresting layer 721 disposed between the chamfered surface 706 of the superabrasive layer 302 and the inner surface 310 of the sleeve 703. Notably, the arresting layer 721 can be in direct contact with the chamfered surface 706 and inner surface 310. Moreover, the arresting layer 721 in certain designs can be directly bonded to the chamfered surface 706 and inner surface 310.

The arresting layer 721 can be formed of a material having a Mohs hardness that is less than a Mohs hardness of the superabrasive layer 302. For example, the arresting layer 721 can be made of a material such as a carbide, nitride, oxide, boride, a carbon-based material, and a combination thereof. Certain suitable types of materials for use in the arresting layer 721 can include ceramics, metals, and cermets. In particular instances, the arresting layer 721 can be formed such that it is made of a carbide. Still, in other designs, the arresting layer 721 can be formed of a metal or metal alloy and may particularly include certain metal elements such as nickel, iron, manganese, chromium, tantalum, vanadium, titanium, cobalt, tungsten, and a combination thereof. For example, one particular type of arresting layer 721 can be made of steel composition. Notably, in particular embodiments, the arresting layer 721 can be formed of a metal braze composition or metal binder composition.

In still other designs, it may be suitable to incorporate certain superalloy compositions within the arresting layer 721. Reference to superalloy materials is reference to refractory metal and metal alloys having superior hardness, and which typically incorporate metal elements such as tungsten, chromium, cobalt, iron, and nickel. Some such suitable superalloys can include nickel-based materials, cobalt-based materials, chromium-based material, and/or cobalt-chromium-based materials. In fact, superalloy compositions include a majority amount of nickel, chromium, and/or cobalt (depending upon the precise composition) and may further include minor amounts of other alloying metal elements, such as molybdenum, tungsten, iron, and manganese. Some minor amounts of elements such as silicon and carbon may also be present. Examples of such materials include STELLITE®, INCONEL®, HASTELLOY® and TALONITE™.

Moreover, designs herein may incorporate an arresting layer 721 that exerts a radially compressive force on the superabrasive layer 302. For example, the arresting layer 721 can be formed such that it exerts a force on the superabrasive layer 302, and a portion of the total force, a majority of the total force, or even essentially all of the total force exerted by the arresting layer 721 can be a radially compressive force applied directly to the chamfered surface 706. Optionally, in some cutting elements, the arresting layer 721 may be in direct contact with the side surface 306 of the superabrasive layer 302, such that it is disposed between the side surface 306 and inner surface 310 of the sleeve 703. In such embodiments, the arresting layer 721 can further exert a radially compressive force on the superabrasive layer 302 at the side surface 306.

Figure 7C:
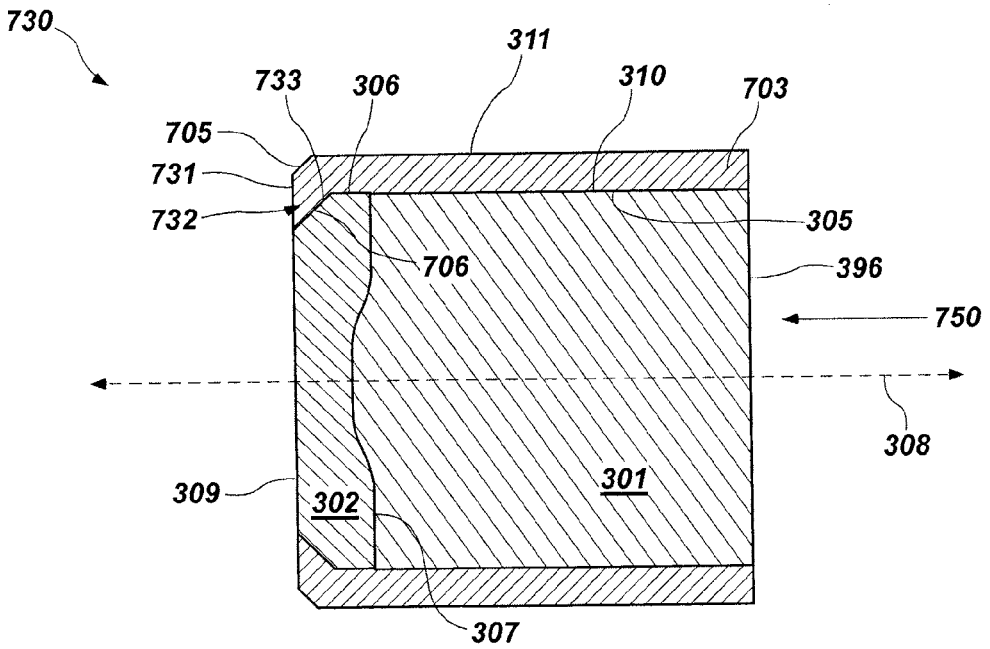

FIG. 7C includes a cross-sectional illustration of a cutting element in accordance with an embodiment. The cutting element 730 includes some of the elements previously described in FIG. 7A. However, the cutting element 730 comprises a sleeve 703 having a different orientation with respect to the superabrasive layer 302 than the cutting element 700 of FIG. 7A. In particular, the sleeve 703 is formed with a protrusion 732 that extends radially inward from the inner surface 310. The protrusion 732 can overly the chamfered surface 706 of the superabrasive layer 302. In particular embodiments, the protrusion 732 is formed such that it directly contacts, and can be directly bonded to, the chamfered surface 706 of the superabrasive layer 302. The protrusion 732 incorporates an inner surface 733 that is angled with respect to the longitudinal axis 308 for complementary engagement with the chamfered surface 706 of the superabrasive layer 302.

The provision of the protrusion 732 on the sleeve 703 may facilitate the exertion of forces on the superabrasive layer 302. In particular, the protrusion 732 can exert a radially compressive force on the superabrasive layer 302. Additionally, the protrusion 732 can be formed such that it applies an axial force to the superabrasive layer 302.

Figure 7D:
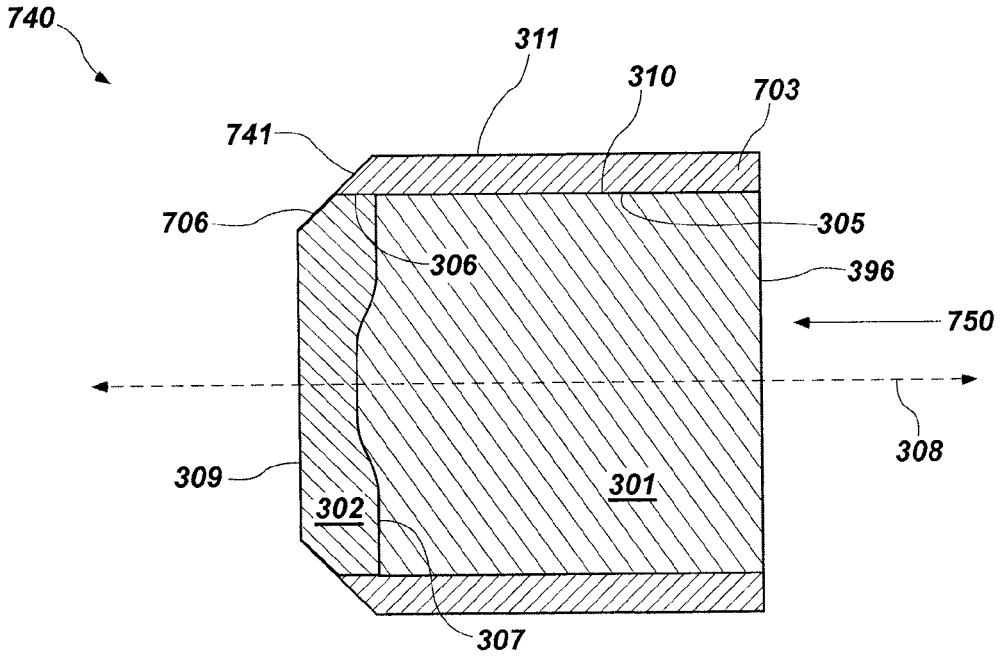

FIG. 7D includes a cross-sectional illustration of a cutting element in accordance with an embodiment. Cutting element 740 includes components described herein, particularly including a cutter body 750 comprising a substrate 301 and a superabrasive layer 302 overlying an upper surface 307 of the substrate 301. The cutting element of 740 further includes a sleeve 703 extending over the side surface 306 of the superabrasive layer 302 and the side surface 305 of the substrate 301. In particular, the sleeve 703 is formed such that it comprises an upper surface 741 that is angled with respect to the longitudinal axis 308 and extends between the inner surface 310 and outer surface 311 of the sleeve 703. In accordance with certain designs, the upper surface 741 of the sleeve can be formed such that it is coplanar with the chamfered surface 706 of the superabrasive layer 302. The cutting element 740 facilitates protrusion of the superabrasive layer 302 in an axial direction beyond the upper surface 741 of the sleeve 703 while maintaining the orientation of the sleeve 703 with respect to the side surface 306 of the superabrasive layer 302 for exertion of forces thereon.

FIGS. 8A-8D include cross-sectional illustrations of cutting elements in accordance with embodiments. Generally, the embodiments of FIGS. 8A-8D include a sleeve that comprises multiple portions, including an upper portion that can overlie at least a portion of the upper surface of the superabrasive layer. In certain instances, the upper portion of the sleeve can overlie a majority, or even the entirety of the upper surface of the superabrasive layer. Accordingly, the sleeve may act as an encapsulating material, which may initiate the cutting in the down hole environment through rock strata or an existing casing, only to erode and later expose the underlying superabrasive layer. Alternatively, the sleeve can be formed to have an uppper portion that selectively overlies portions of the superabrasive layer, while leaving other portions of the superabrasive layer exposed.

Figure 8A:
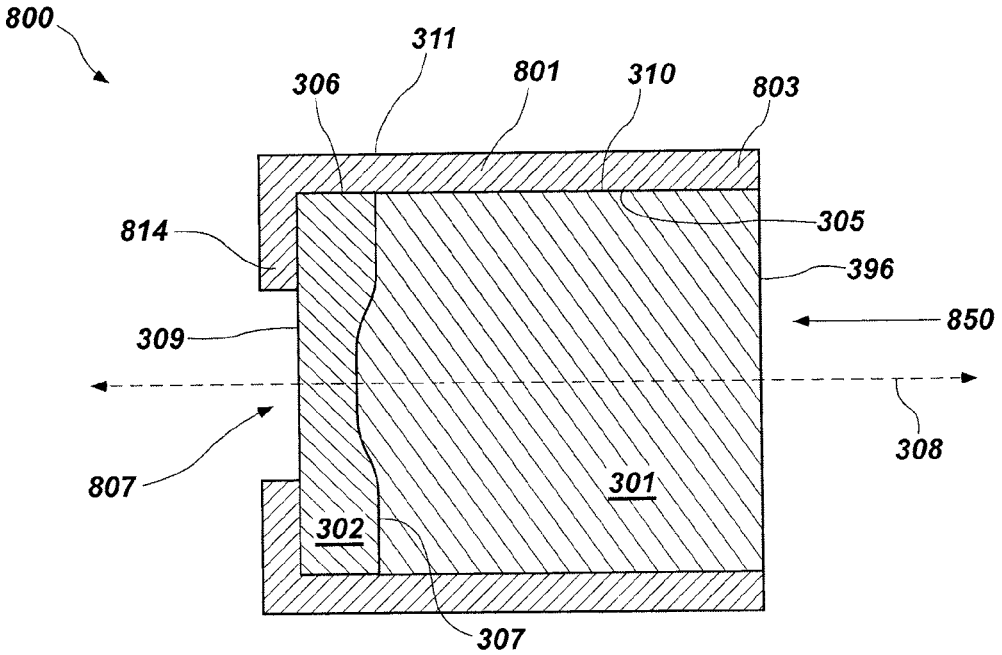
FIGS. 8A-8D include cross-sectional illustrations and a side view illustration of cutter elements in accordance with embodiments.

FIG. 8A includes a cross-sectional illustration of a cutting element 800 comprising a cutter body 850, and a sleeve 803 encapsulating a majority of the cutter body 850. As illustrated, the sleeve 803 is formed such that it has a side portion 801 extending over the side surface 306 of the superabrasive layer 302 and the side surface 305 of the substrate 301. Moreover, the sleeve 803 further includes a portion 814 extending perpendicularly to the longitudinal axis 308 and overlying a portion of the upper surface 309 of the superabrasive layer 302. The portion 814 can be bonded to the side portion 801. However, particular embodiments utilize a sleeve wherein the side portion 801 and upper portion 814 are part of a single, monolithic object that may not necessarily be separate components bonded together.

In accordance with certain designs, the sleeve 803 is formed such that the upper portion 814 overlies at least about 50% of the total surface area of the upper surface 309 of the superabrasive layer 302. That is, as illustrated, the upper portion 814 can overlie a portion of the upper surface 309 of the superabrasive layer 302 such that a central opening 807 exists in the upper portion 814 where the upper surface 309 of the superabrasive layer 302 is exposed (i.e., uncovered). In certain designs, the exposed portion of the superabrasive layer 302 within the central opening 807 can be centered around the longitudinal axis 308. The upper portion 814 can overlie a greater amount of the upper surface 309, such as at least about 75%, at least about 80%, or even at least about 90% of the upper surface 309 of the superabrasive layer 302. In one particular design, the upper portion 814 overlies and the entirety of the upper surface 309 of the superabrasive layer 302.

As illustrated, the upper portion 814 of the sleeve 803 can be in direct contact with the upper surface 309. In certain instances, the upper portion 814 is formed such that it can be in direct contact with, and even directly bonded to, the upper surface 309 of the superabrasive layer 302. As such, cutting elements like cutting element 800 illustrated in FIG. 8A comprise a sleeve 803 that can exert forces on the superabrasive layer 302. In particular, the upper portion 814 can exert an axially compressive force, a radially compressive force, or a combination thereof, that is directly applied to the upper surface 309 of the superabrasive layer 302.

Figure 8B:
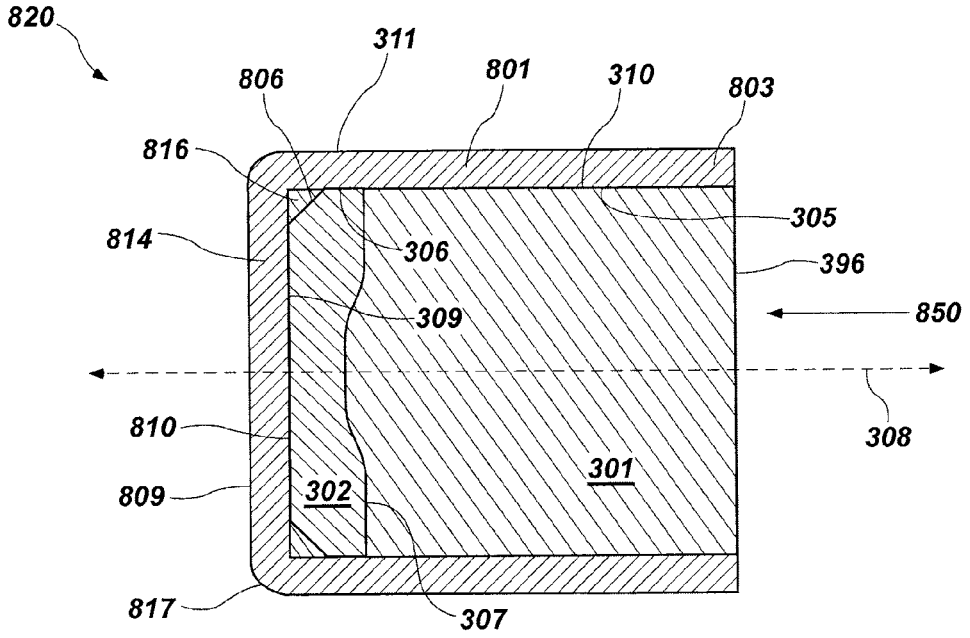

FIG. 8B includes a cross-sectional illustration of a cutting element in accordance with an embodiment. In particular, FIG. 8B includes a cutting element 820 having certain components described in the embodiment of FIG. 8A. Notably, the cutting element 820 is formed such that the cutter body 850 comprises a superabrasive layer 302 having a chamfered surface 806 extending at an angle to the longitudinal axis 308 between the upper surface 309 and side surface 306 of the superabrasive layer 302. The sleeve 803 comprises a side portion 801 extending over the side surface 305 of the substrate 301 and the side surface 306 of the superabrasive layer 302. The sleeve 803 further comprises a upper portion 814 extending over the entirety of the upper surface 309 of the superabrasive layer 302. Notably, the sleeve 803 comprises a radiused edge 817 extending between the outer surface 311 of the sleeve side portion 801 of the sleeve 803 and the upper surface 809 of the upper portion 814 of the sleeve 803. As will be appreciated, the radiused edge can have various curvatures depending upon intended application of the cutter.

The cutting element 820 further includes an arresting layer 816 disposed within a gap between the chamfered surface 806 of the superabrasive layer 302 and the inner corner of the sleeve 803 defined by the conjunction of the inner surface 310 of the side portion 801 and an inner surface 810 of the upper portion 814. The arresting layer 816 can incorporate the same materials, have the same orientation, and exert the same forces on the superabrasive layer 302 as the arresting layer 721 as described in the embodiment of FIG. 7B.

Figure 8C:
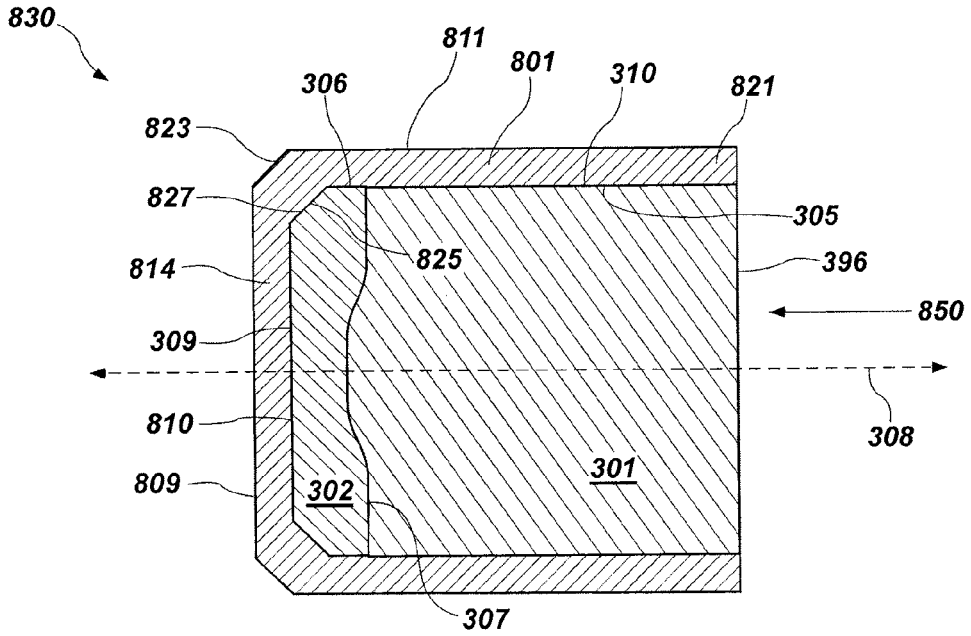

FIG. 8C includes a cross-sectional illustration of a cutting element in accordance with an embodiment. In particular, FIG. 8C includes a cutting element 830 having those components described in the embodiment of FIG. 8A. Notably, the cutting element 830 is formed such that the cutter body 850 comprises a superabrasive layer 302 having a chamfered surface 825 extending at an angle to the longitudinal axis 308 between the upper surface 309 and side surface 306 of the superabrasive layer 302. The sleeve 821 can be formed such that it comprises a chamfered surface 823 extending at an angle to the longitudinal axis 308 between the upper surface 809 of the upper portion 814 and the side surface 811 of the side portion 801. Additionally, the sleeve 821 can include a chamfered surface 827 along its inner surface extending at an angle to the longitudinal axis 308 between the inner surface 310 of the side portion 801 and the inner surface 810 of the upper portion 814. As such, the chamfered surface 827 can have the same angle and length of the chamfered surface 825 of the superabrasive layer 302 for complementary engagement of the surfaces 825 and 827 and proper orientation between the cutter body 850 and sleeve 821. Various angles and lengths of the chamfered surfaces 825 and 827 may be employed.

Figure 8D:
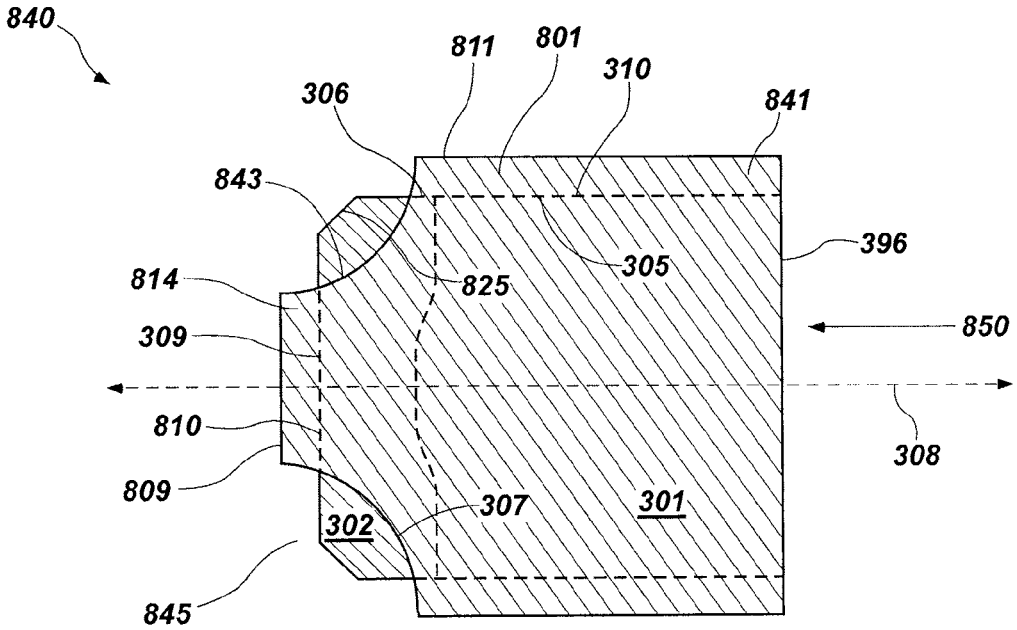

FIG. 8D includes a side view illustration of a cutting element in accordance with an embodiment. In particular, FIG. 8D includes a cutting element 840 having certain components described in the embodiment of FIG. 8A. Notably, the cutting element 840 is formed such that the cutter body 850 comprises a superabrasive layer 302 having a chamfered surface 825 extending at an angle to the longitudinal axis 308 between the upper surface 309 and side surface 306 of the superabrasive layer 302. Additionally, as illustrated in the embodiment, the sleeve 841 can be formed such that it comprises a surface 843 which can extend in an arcuate manner to the side surface 811 of the side portion 801 and upper surface 809 of the upper portion 814 of the sleeve 841. The surface 843 facilitates the formation of an opening 845, wherein a portion of the superabrasive layer 302 is exposed (i.e., not underlying the sleeve 841), and particularly, the chamfered surface 825 as shown by dashed line, of the superabrasive layer 302 is exposed. The opening 845 within the sleeve 841 can be shaped to have any contour to effectively expose a portion of the superabrasive layer 302. As illustrated the surface 843 may comprise a curved contour to increase the exposure of the superabrasive layer 302, however, in other embodiments, it may include simply a straight, chamfered surface.

As illustrated, the upper portion 814 of the sleeve 841 can be in direct contact with the upper surface 309 of the superabrasive layer 302. In certain instances, the upper portion 814 is formed such that it can be in direct contact with, and even directly bonded to, the upper surface 309 of the superabrasive layer 302. As such, cutting elements like cutting element 840 illustrated in FIG. 8D comprise a sleeve 841 that can exert forces on the superabrasive layer 302. In particular, the upper portion 814 can exert an axially compressive force, a radially compressive force, or a combination thereof, that is directly applied to the upper surface 309 of the superabrasive layer 302. Moreover, the design of the sleeve 841 is such that it can directly overlie the center point of the upper surface 309 of the superabrasive layer 302, such that even during use, the sleeve 841 can maintain its position and continue to exert forces on the superabrasive layer 302.

With regard to the embodiments of FIG. 8A-8D, it will be appreciated that such cutters can be employed in rotary drag bits. Moreover, such cutting elements may be particularly suitable for use in mill-and-drill bits which are designed to mill through obstructions (e.g., casings) contained within a borehole before continuing a drilling process configured to subsequently engage subterranean (i.e., rock). As such, the provision of the sleeve overlying the upper surface of the superabrasive layer facilitates protection of the superabrasive layer 302 while the bit is milling through an obstruction, saving the superabrasive layer 302 for engagement for subterranean formations for efficient drilling operations.

Figure 9A:
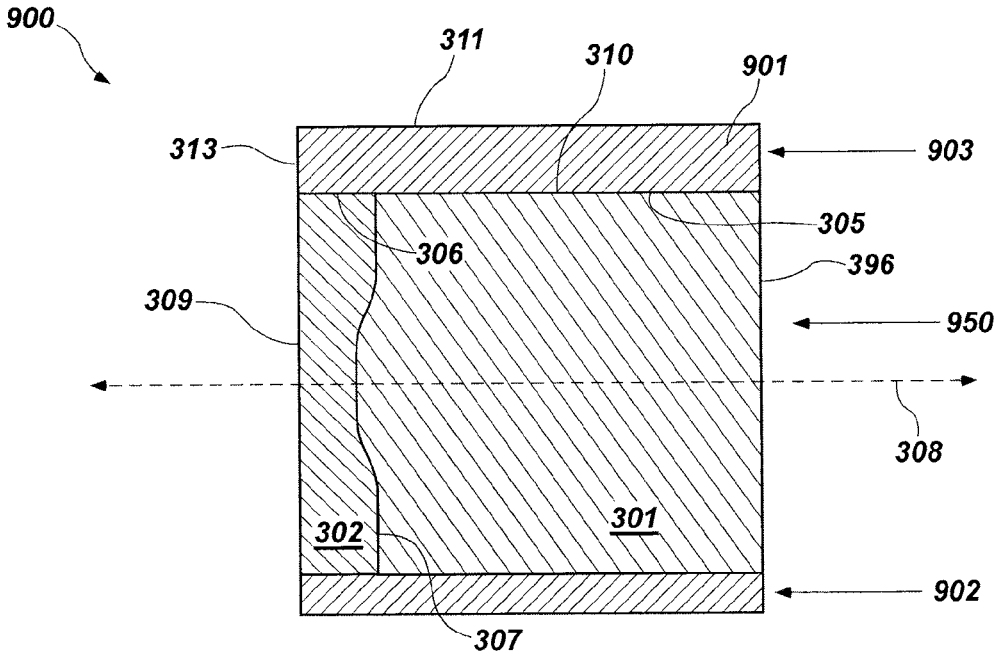
FIGS. 9A-9B include a cross-sectional illustration and a perspective view illustration of a cutter element in accordance with an embodiment.
Figure 9B:
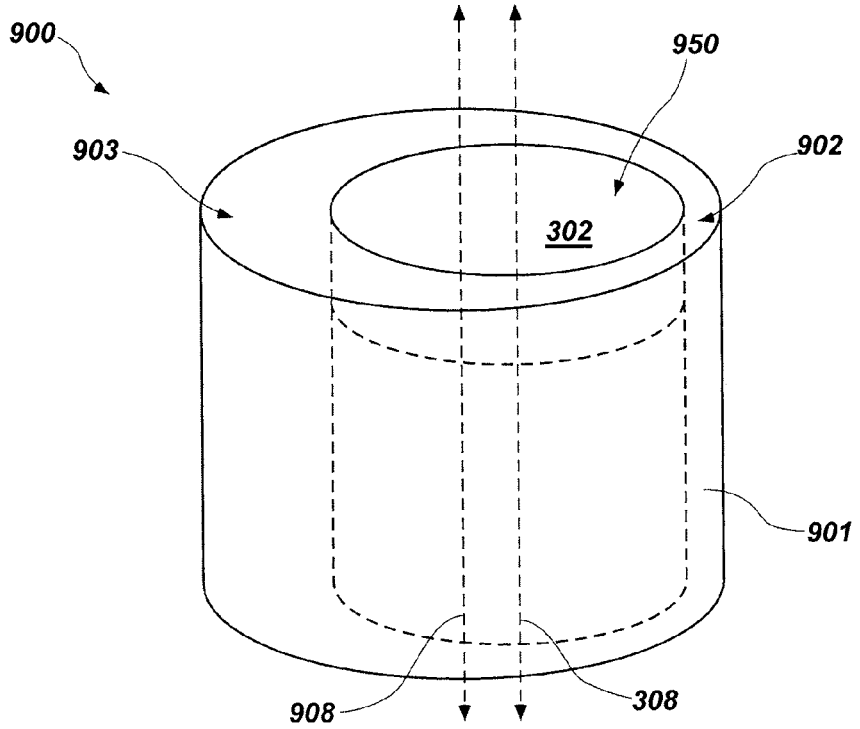

FIGS. 9A-9B include a cross-sectional illustration and a perspective view illustration of a cutting element in accordance with an embodiment. FIG. 9A includes a cross-sectional illustration of a cutting element 900 having a cutter body 950 comprising a asubstrate 301 and a superabrasive layer 302 overlying an upper surface 307 of the substrate 301. The cutting element 900 further includes a sleeve 901 overlying the side surface 306 of the superabrasive layer 302 and the side surface 305 of the substrate 301. The sleeve 901 is formed such that it has a thickness that varies radially. That is, the thickness of the sleeve 901 changes at different radial position along the sleeve 901. As illustrated, the sleeve 901 has a thickness within region 903 that is significantly greater than the thickness of the sleeve 901 within region 902.

Additionally, according to certain embodiments, the cutting element 900 can be formed such that the cutter body 950 and the sleeve 901 are oriented in a non-concentric relationship to one another. FIG. 9B includes a perspective view illustration of the cutting element 900 for a fuller understanding of the orientation between the components. As shown, the cutter body 950 can be disposed within the opening of the sleeve 901 such that the longitudinal axis 308 of the cutter body 950, which extends through a center point of the cutter body 950, is spaced apart from and extends along a different axis than a longitudinal axis 908 extending through a center point of the sleeve 901. Such a configuration may facilitate the orientation of the cutting element 900 within a bit, such that the thinner portion of the sleeve 901 within region 902 is configured to initiate cutting, while the thicker portion of the sleeve 901 within the region 903 is configured to maintain the cutter body 950 within the sleeve 901.

Figure 10:
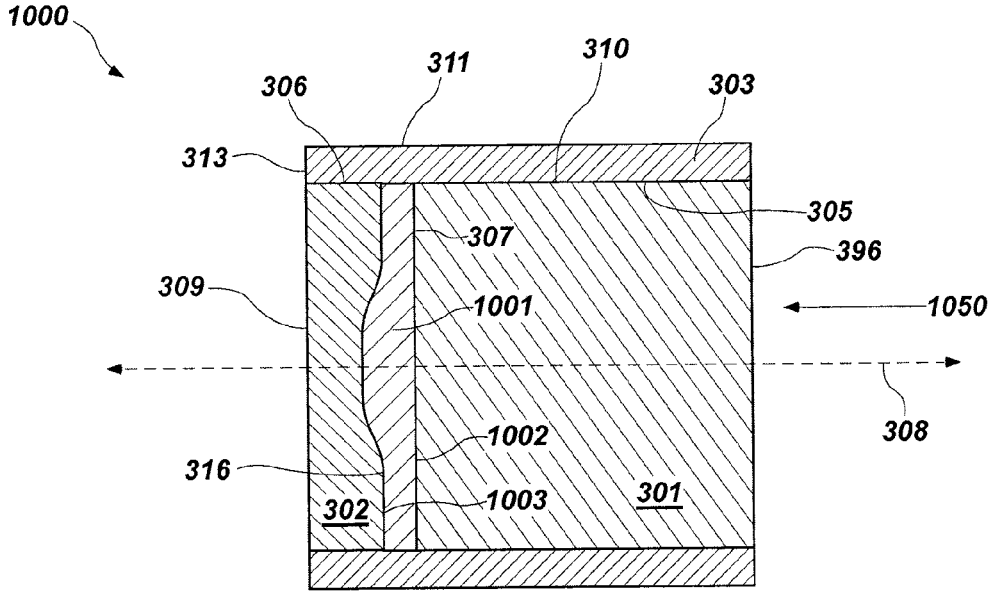
FIG. 10 includes a cross-sectional illustration of a cutter element in accordance with an embodiment.

FIG. 10 includes a cross-sectional illustration of a cutting element in accordance with an embodiment. The cutting element 1000 includes a cutter body 1050 comprising a substrate 301 and a sup erabrasive layer 302 overlying an upper surface 307 of the substrate 301. The cutting element 1000 further includes a sleeve 303 overlying a portion of the side surface 306 of the superabrasive layer 302 and a portion of the side surface 305 of the substrate 301. The cutting element 1000 includes an intermediate layer 1001 disposed between the upper surface 307 of the substrate 301 and the rear surface 316 of the superabrasive layer 302. In particular embodiments, the intermediate layer 1001 comprises a rear surface 1002 that is in direct contact with, and can be directly bonded to, the upper surface 307 of the substrate 301. Moreover, the intermediate layer 1001 can have an upper surface 1003 in direct contact with, and can be directly bonded to, the rear surface 316 of the superabrasive layer 302.

The intermediate layer 1001 can be made of a material such as a carbide, carbon-based material, and a combination thereof. In particular instances, the intermediate layer 1001 can be made of a carbide, such as a metal carbide like titanium carbide or tungsten carbide. Still, in other instances, the intermediate layer 1001 can be formed of a diamond material, such as a polycrystalline diamond material. In yet other designs, a cermet material may be utilized within the intermediate layer 1001.

While the intermediate layer 1001 can be made of a different material than the superabrasive layer 302 or the substrate 301, in certain designs, the intermediate layer 1001 can include the same materials as the superabrasive layer 302 or the substrate 301 and yet have different material characteristics than the superabrasive layer 302. This can be achieved by using different feed material (or a grade of material) in forming the different components (i.e., substrate 301, intermediate layer 1001, and superabrasive layer 302). For example, in one embodiment, the superabrasive layers 302 and the intermediate layer 1001 can include a diamond material (e.g., PDC or TSP), wherein the superabrasive layer 302 is formed from a different diamond feed material than the intermediate layer 1001. The feed material can be varied to control performance characteristics of the as-formed layer. For example, the feed material used to form the layers can be distinguished based upon the size of the grains, the size distribution of the grains, quality of the grains (compositional purity, etc.), which can affect toughness, abrasiveness, and other mechanical characteristics. That is, in certain embodiments, a feed material can be used to form the superabrasive layer 302 such that it has greater abrasiveness as compared to the feed material used to form the intermediate layer 1001, which may be formed to have a greater toughness as compared to the superabrasive layer 302.

The intermediate layer 1001 can be formed to have an upper surface 1003 having a contoured region like the upper surface 307 of the substrate 301 in FIG. 4. While not illustrated, it will be appreciated, that the substrate 301 can also include a contoured region in the upper surface 307. Such a design may improve bonding between the substrate 301 and the superabrasive layer 302 and also reduce stresses within the superabrasive layer 302. As will be appreciated, other contours within the upper surface 1003 of the intermediate layer 1001 may be utilized, including for example, a series of protrusions and/or series of grooves, which may further form a pattern, such as an arrangement of protrusions appearing as spokes extending radially along the upper surface 1003.

Notably, the intermediate layer 1001 is formed such that it can exert forces on the superabrasive layer 302. For instance, the intermediate layer 1001 can be formed to exert some radially compressive forces on the superabrasive layer 302 at the interface between the upper surface 1003 and rear surface 316 of the superabrasive layer 302.

Additionally, while not illustrated, the intermediate layer 1001 can comprise a plurality of discrete films, wherein each of the films comprises a different characteristic relative to an abutting film. Use of a plurality of discrete films within the intermediate layer 1001 may improve bonding between the substrate 301, intermediate layer 1001, and superabrasive layer 302. Moreover, the use of an intermediate layer 1001 comprising a plurality of discrete films may include the formation of a graded structure. That is, an intermediate layer having a composition that changes through the formation of a discrete films having different grades. Films of different grade can include films that differ based upon the material composition of the materials between two films or that have difference in microstructure (e.g., size of grains, shape of grains, distribution of sizes and shapes of grains, etc.)

The cutting elements herein may be formed by particular methods such that the components are properly oriented with respect to each other and forces between components are applied as described herein. In accordance with an embodiment, one method of forming includes forming the cutter body comprising the substrate and superabrasive layer as illustrated in embodiments herein. One particular method of forming the cutter body can include a high pressure high temperature (HP/HT) process.

In a HP/HT process, substrate material is loaded into a HP/HT cell with an appropriate orientation and amount of diamond crystal material, typically of a size of 100 microns or less. Furthermore, a metal catalyst powder can be added to the HP/HT cell, which can be provided in the substrate or intermixed with the diamond crystal material. The loaded HP/HT cell is then placed in a process chamber, and subject to high temperatures (typically 1450° C.-1600° C.) and high pressures (typically 50-70 kilobar), wherein the diamond crystals, stimulated by the catalytic effect of the metal catalyst powder, bond to each other and to the substrate material to form a PDC product. It will be appreciated that the PDC product can be further processed to form a thermally stable polycrystalline diamond material (commonly referred to as "TSP") by leaching out the metal in the diamond layer. Alternatively, silicon, which possesses a coefficient of thermal expansion similar to that of diamond, may be used to bond diamond particles to produce a Si-bonded TSP. TSPs are capable of enduring higher temperatures (on the order of 1200° C.) in comparison to normal PDCs.

The process of forming the cutting elements herein may further include a process of forming a sleeve having the dimensions described herein and particularly a central opening for engagement of the cutter body therein. Various forming methods may be undertaken to form the sleeve. For example, a HP/HT process may be used to form the sleeve. In particular instances, the cutter body and sleeve may be formed in the same high-pressure/high-temperature process. In certain instances, the formation of the cutter body and the sleeve can be completed simultaneously, such that they are formed in the same chamber at the same time. Such a process may require a special HP/HT cell capable of accommodating both components.

In accordance with other embodiments, depending upon the material of the sleeve selected, the sleeve may be formed through a different method. For example, some suitable methods of forming the sleeve can include machining, casting, molding, pressing, forging, sintering, and a combination thereof.

After forming the cutter body and sleeve, the cutter body and sleeve may be fitted together such that the cutter body is placed within the central opening of the sleeve in a manner such that the sleeve exerts radially compressive forces on the cutter body, and particularly the superabrasive layer. In accordance with one embodiment, the process of fitting the cutter body and sleeve together includes a process of creating a temperature differential between the cutter body and sleeve. The process of creating a temperature differential may include increasing the temperature of the sleeve, such as by heating the sleeve to a temperature greater than a temperature of the cutter body. Such a process may facilitate an increase in the dimensions of the sleeve, such that the diameter of the central opening is increased sufficiently for fitting of the cutter body within the sleeve. As such, the dimensions of the sleeve may initially be created such that the cutter body may not necessarily fit within the central opening of the sleeve. However, after providing a temperature differential between the two components, the cutter body and sleeve can be combined such that the cutter body fits within the opening of the sleeve.

Alternatively, the process of creating a temperature differential between the cutter body and sleeve can include a process of decreasing the temperature of the cutter body relative to the temperature of the sleeve. Such a process may facilitate reduction in the dimensions of the cutter body such that the cutter body fits within the central opening of the sleeve. It will be appreciated that the process of creating the temperature differential can include one or a combination of the techniques. That is, the temperature of the sleeve can be changed relative to the cutter body, the temperature of the cutter body can be changed relative to the sleeve, or the temperature of both components may be changed relative to each other to complete the fitting process.

In accordance with one particular embodiment, the temperature differential is at least about a 10% difference in temperature between the two components based on the greater of the two temperatures. For example, the percentage difference in temperature differential can be calculated based on the equation: $((T1-T2)/T1)\times 100$, wherein $T1 \geq T2$. Other processes may utilize a greater temperature differential, such as on the order of at least about 25% difference, at least about 50% difference, at least about 75% difference or even at least about a 90% difference in temperature between the components. Still, creation of the temperature differential may be controlled to lessen the likelihood of temperature induced damages to the components, and accordingly the temperature differential may be within a range between about 10% and about 90%, between about 10% and about 75%, or even between about 10% and 50% difference in temperature between the two components.

Upon creating a sufficient temperature differential, the cutter body can be disposed within the central opening of the sleeve, and the components can be fitted together and properly oriented with respect to each other. It has been revealed that a sufficient clearance or gap distance must be utilized, by virtue of the temperature differential, between the inner diameter of the sleeve and the outer diameter of the cutter body to affect proper fitting of the two components. According to studies conducted, it has been found that a clearance of at least about 0.005 cm between the two components is suitable for proper fitting. Additionally, some processes may utilize a greater clearance, such as at least about 0.0075 cm, at least about 0.01 cm, at least about 0.02 cm, or even greater. Particular temperature differentials according to processes herein can facilitate the creation of a clearance of between about 0.005 cm and about 0.02 cm.

After properly fitting the two components together the temperature differential between the components can be removed. Reduction or removal of the temperature differential can include cooling of the components together, heating of the components together, or a combination thereof. As such, upon removal of the temperature differential between the two components, the diameter of the central opening of the sleeve with respect to the cutter body is such that a radially compressive force is exerted by the sleeve on the side surfaces of the cutter body.

It will further be appreciated that in some processes, a bonding material may be placed at the interface between the sleeve and the cutter body to facilitate joining the two components. Suitable bonding materials may be inorganic or organic materials. For example, the bonding material can be a braze material incorporating a metal or metal alloy material. Metal materials of particular use may include metal elements including, for example, nickel, iron, manganese, chromium, tantalum, vanadium, titanium, cobalt, tungsten, and a combination thereof. Notably, superalloy metals as described herein can also be employed.

While particular reference to the process of fitting the components together has focused on the use of a temperature differential, other processes may be used. For example, it is contemplated that a mechanical force may be applied to the sleeve, cutter body, or both, to affect the fitting of the cutter body within the central opening of the sleeve. In one particular instance, a force can be applied to the sleeve to increase the inner diameter of the central opening to allow the cutter body to fit within the sleeve. As such, in particular instances, the cutter body may be extruded into the sleeve, such that a mechanical urging force is applied to the substrate to urge the cutter body into the central opening of the sleeve, and thereby creating a cutting element wherein the sleeve exerts forces (e.g., radial and axial forces) on the cutter body.

In other processes, a press fitting operation can be used to fit the components (i.e., the sleeve and the cutter body) together. Press fitting operations can utilize the application of force on the cutter body and/or sleeve to affect fitting of the sleeve and cutter body together in a manner that the sleeve exerts at least a radially compressive force on the cutter body. In particular instances, the press fitting operation can include the formation of a sleeve having a central opening designed to allow the cutter body to fit within the central opening. This may be accomplished with or without the application of a temperature differential or other forces to the sleeve. During the press fitting operation, the cutter body can be forced into the central opening of the sleeve, such that the sleeve is forced to expand, and, consequently, the sleeve also applies opposite forces to the cutter body. In particular instances, it may be particularly suitable to introduce the cutter body into the sleeve such that the superabrasive layer is first introduced into the central opening. The cutter body is axially displaced through force within the central opening until the proper fit is obtained and the cutter body is properly seated within the sleeve. It will be appreciated that chamfered surfaces on the rear of the sleeve or on the superabrasive layer or both may aid the initiation of the fitting operation.

After fitting the cutter body within the central opening of the sleeve, a radially compressive force can be applied to the sleeve and cutter body to physically reduce the size of the sleeve and compress the sleeve. Compression of the sleeve can facilitate the creation of a frictional bond between the two components and the exertion of a radially compressive force on the cutter body by the sleeve. It will be appreciated that certain mechanical features at the interface of the sleeve and cutter body, particularly the substrate, may be utilized to facilitate locking engagement and maintaining the compressive state of the sleeve.

Embodiments herein may utilize a particular difference in materials used to form the components such as the sleeve, superabrasive layer, and substrate. Notably, the sleeve may be formed of a material having a coefficient of thermal expansion (CTE) that is different than the coefficient of thermal expansion of the material of the superabrasive layer. In accordance with embodiments herein, the sleeve and the superabrasive layer can comprise CTEs that are at least about 5% different as measured at 300 K based on the greater CTE. For example, the percentage difference in CTE can be calculated based on the equation: $((CTE\mathbf{1}-CTE\mathbf{2})/CTE\mathbf{1})\times 100$, wherein $CTE\mathbf{1}\geq CTE\mathbf{2}$. In other designs, the difference may be greater, such as at least about 10%, at least about 15%, at least about 20%, or even at least 25% difference in CTE between the sleeve and superabrasive layer at 300 K. Still, particular embodiments may utilize a difference in CTE between the sleeve and superabrasive layer as measured at 300 K within a range between about 5% and 90%, such as between 5% and 75%, between about 5% and about 50%, or even between about 5% and 25%. In such embodiments, it may be particularly suitable that the CTE of the sleeve material is greater than the CTE of the superabrasive layer.

The description herein has indicated that certain embodiments may utilize a CTE difference between certain components, such as the sleeve, cutter body, and particularly the superabrasive layer. However, it has been revealed that in certain embodiments, a cutting element can be formed wherein a radially compressive force is applied by the sleeve on the superabrasive layer, wherein the relationship between the CTE of the sleeve ($CTE_s$) and the CTE of the superabrasive layer ($CTE_{sal}$) is as follows: $((CTE_s-CTE_{sal})/CTE_s)\times 100$, wherein $CTE_s\geq CTE_{sal}$. Notably, in such designs, the CTE of the sleeve can be equal to the CTE of the superabrasive layer. More particularly, the CTE of the sleeve can be greater than the CTE of the superabrasive layer. In such embodiments, the percentage difference in CTE between the sleeve and the superabrasive layer are the same as the percentage differences described in accordance with embodiments herein.

In other terms, the embodiments herein can employ a sleeve having a CTE that is at least about one order of magnitude greater than the CTE of the superabrasive layer 302 as measured at 300 K. That is, the difference in CTE between the sleeve and the superabrasive layer is at least a multiple of ten. In more particular instances, the sleeve can have a CTE that is at least two orders of magnitude greater than the CTE of the sleeve, or even on the order of at least three orders of magnitude greater. Certain designs according to embodiments herein can utilize a sleeve having a CTE that is between about one order of magnitude and about four orders of magnitude greater than the CTE of the superabrasive layer.

While particular reference above is made to the difference in CTE between the sleeve and the superabrasive layer, it will be appreciated that such differences in CTE may also be employed between other components, particularly between the sleeve and substrate, the intermediate layer and the substrate, and/or the intermediate layer and the superabrasive layer. Moreover, such differences in CTE may be utilized between discrete films within the intermediate layer.

Additionally, cutting elements of embodiments herein may utilize components that have a difference in other properties, particularly a difference in Modulus of Elasticity (MOE). Notably, the sleeve can have a MOE that is different than the MOE of the superabrasive layer. Differences in the MOE between the sleeve and superabrasive layer may be utilized to control forces exerted on the superabrasive layer by the sleeve and facilitate improved performance. In particular instances, the cutting elements herein may utilize a difference in MOE between the sleeve and superabrasive layer of at least 5% based on the greater MOE. For example, the percentage difference in MOE can be calculated based on the equation: $((MOE\mathbf{1}-MOE\mathbf{2})/MOE\mathbf{1})\times 100$, wherein $MOE\mathbf{1}\geq MOE\mathbf{2}$. In other embodiments, the difference may be greater, such as on the order of at least about 10%, at least about 25%, at least about 50%, or even at least about 75%. Still, particular embodiments may utilize a difference in MOE between the sleeve and superabrasive layer within a range between about 5% and 75%, such as between 5% and 50%, or even between 5% and 25%.

While particular reference above is made to the difference in MOE between the sleeve and the superabrasive layer, it will be appreciated that such differences in MOE may also be employed between other components, particularly between the sleeve and substrate, the intermediate layer and the substrate, and/or the intermediate layer and the superabrasive layer.

The difference in properties noted above may be achieved by utilizing components made of different materials, and, particularly, components having distinct chemical compositions. For example, according to one embodiment, the sleeve and the substrate can be made of a cemented tungsten carbide material. However, the sleeve and the substrate may employ different percentages of certain elements within the components, such as a catalyst material (e.g., cobalt). Such differences can affect mechanical properties such as toughness and abrasiveness. In one particular embodiment, the sleeve is made of cemented tungsten carbide having a content of catalyst material that is at least about 5% lower than the cemented tungsten carbide material of the substrate.

Additionally, components herein may have distinct mechanical performance based on differences in microstructure. For example, the sleeve can be formed of a cemented tungsten carbide material formed from a feed material that is distinct from the tungsten carbide feed material used to form the substrate. The feed material can be varied based on parameters such as size distribution of the grains, quality of the grains, and aspect ratio of the grains to affect certain mechanical properties.

While reference above is made to the differences in properties between the sleeve and the substrate, such discussion is illustrative and it will be appreciated that such these differences may exists between other components based on a difference in composition and feed material. Particularly, these differences can exist between the intermediate layer and the substrate, and/or the intermediate layer and the sleeve.

The cutting elements herein demonstrate a departure from the state of the art. While cutters designs have been disclosed in the past to mitigate problems associated with mechanical strain, temperature-induced strain, and wear, typically the changes in cutter design have been directed to changing the configuration of the cutter table and/or substrate and the interface between these two components. By contrast, the embodiments herein are directed to cutting elements incorporating multiple components employing a cutter body, a sleeve, an intermediate layer, arresting layers, multiple chamfers and/or radiused edges, and for improved performance. Embodiments herein further include a combination of features directed to the orientation between the components, different structures of the components (e.g., layered structures), various materials for use in the components, particular surface features of the components, certain means of affixing the components to each other, and the application of certain types of forces at certain locations between the components. Moreover, the cutting elements of the embodiments herein can be formed through particular forming methods not previously utilized in the art, which facilitate the features of the cutting elements herein.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A cutting element for use in a drilling bit and/or milling bit comprising:

a cutter body comprising:

a substrate having an upper surface; and a superabrasive layer overlying the upper surface of the substrate, the superabrasive layer comprising an upper surface extending transversely to a longitudinal axis of the cutter body, a rear surface opposite the upper surface, a side surface extending between the upper surface and the rear surface, and a chamfered surface extending at an angle to the longitudinal axis of the cutter body between the upper surface and the side surface; and a sleeve extending entirely circumferentially around and directly contacting a side surface of the superabrasive layer and a side surface of the substrate, wherein the sleeve exerts a radially compressive force on the superabrasive layer; and a layer of material having a Mohs hardness that is less than a Mohs hardness of the superabrasive layer disposed between the chamfered surface and the sleeve.

2. The cutting element of claim 1, wherein the substrate comprises a material selected form the group of materials consisting of carbides, oxides, borides, nitrides, and a combination thereof.

3. The cutting element of claim 1, wherein the superabrasive layer comprises a material selected from the group of materials consisting of carbides, nitrides, borides, oxides, carbon-based materials, and a combination thereof.

4. The cutting element of claim 1, wherein the sleeve extends over a substantial portion of the side surface of the superabrasive layer.

5. The cutting element of claim 4, wherein the layer of material having a Mohs hardness that is less than a Mohs hardness of the superabrasive layer is in direct contact with the chamfered surface and the sleeve.

6. The cutting element of claim 1, wherein the layer of material having a Mohs hardness that is less than a Mohs hardness of the superabrasive layer exerts a radially compressive force on the superabrasive layer.

* * * * *

UNITED STATES PATENT AND TRADEMARK OFFICE

CERTIFICATE OF CORRECTION

PATENT NO. : 8,757,299 B2
APPLICATION NO. : 12/832817
DATED : June 24, 2014
INVENTOR(S) : Anthony A. DiGiovanni et al.

It is certified that error appears in the above-identified patent and that said Letters Patent is hereby corrected as shown below:

On the title page:

| | |
|---|---|
| In ITEM (75) Inventors: | change "**Nicholas J. Lyons**, Sugar Land, TX (US);" to --**Nicholas J. Lyons**, Houston, TX (US);-- |
| In ITEM (73) Assignees: | change "**Element Six (Production) (Pty) Ltd.**, Gauteng (ZA)" to --**Element Six (Production) (Pty) Ltd.**, Springs, Gauteng (ZA)-- |

In the specification:

| | | |
|---|---|---|
| COLUMN 4, | LINE 7, | change "The substrate provides" to --The substrate **301** provides-- |
| COLUMN 5, | LINE 40, | change "axis **308**) the cutter" to --axis **308**) of the cutter-- |
| COLUMN 5, | LINE 55, | change "the substrate **303**." to --the substrate **301**.-- |
| COLUMN 5, | LINE 62, | change "the sleeve can" to --the sleeve **303** can-- |
| COLUMN 6, | LINE 40, | change "substrate may be" to --substrate **301** may be-- |
| COLUMN 6, | LINE 48, | change "that is has" to --that it has-- |
| COLUMN 7, | LINE 7, | change "metal alloy material." to --metal alloy materials.-- |
| COLUMN 7, | LINE 10, | change "cobalt, irons," to --cobalt, iron,-- |
| COLUMN 8, | LINE 5, | change "and moreover, patterned of shapes" to --and, moreover, patterned shapes-- |
| COLUMN 8, | LINE 12, | change "embodiments, In" to --embodiments. In-- |
| COLUMN 14, | LINE 25, | change "an uppper portion" to --an upper portion-- |
| COLUMN 14, | LINE 34, | change "a portion **814**" to --an upper portion **814**-- |
| COLUMN 14, | LINE 37, | change "The portion **814**" to --The upper portion **814**-- |
| COLUMN 14, | LINES 56-57, | change "overlies and the entirety" to --overlies an entirety-- |
| COLUMN 16, | LINE 37, | change "for engagement for" to --for engagement with-- |
| COLUMN 17, | LINE 39, | change "layers **302**" to --layer **302**-- |

In the claims:

| | |
|---|---|
| CLAIM 2, COLUMN 24, LINE 23, | change "selected form the" to --selected from the-- |

Signed and Sealed this
Seventeenth Day of May, 2016

Michelle K. Lee

Michelle K. Lee
*Director of the United States Patent and Trademark Office*